US005697203A

United States Patent [19]

Niwa

[11] Patent Number: 5,697,203

[45] Date of Patent: Dec. 16, 1997

[54] PRODUCTION UNIT OF LONG-TERM PRESERVABLE LUNCH AND LUNCH BOX USED FOR SAID LUNCH

[75] Inventor: Mitsuo Niwa, Yokohama, Japan

[73] Assignee: Hachiku Shoji Kabushikikaisha, Kanagawa, Japan

[21] Appl. No.: 185,905

[22] PCT Filed: May 20, 1992

[86] PCT No.: PCT/JP92/00645

§ 371 Date: Jan. 20, 1994

§ 102(e) Date: Jan. 20, 1994

[87] PCT Pub. No.: WO93/23290

PCT Pub. Date: Nov. 25, 1993

[51] Int. Cl.[6] ..... B65B 31/00

[52] U.S. Cl. ..... 53/510; 99/477

[58] Field of Search ..... 53/510, 511, 79, 53/110, 432, 109, 88; 426/396, 316; 99/467, 477

[56] References Cited

U.S. PATENT DOCUMENTS

| | | | |
|---|---|---|---|
| 4,140,159 | 2/1979 | Domke | 53/110 |
| 5,001,878 | 3/1991 | San Filippo et al. | 53/510 |
| 5,020,303 | 6/1991 | Vokins | 53/510 |
| 5,071,667 | 12/1991 | Grune et al. | 426/396 |
| 5,077,954 | 1/1992 | Williams | 53/510 |
| 5,247,746 | 9/1993 | Johnson et al. | 53/510 |
| 5,371,998 | 12/1994 | Johnson et al. | 53/510 |

FOREIGN PATENT DOCUMENTS

| | | | |
|---|---|---|---|
| 0411769 | 2/1991 | European Pat. Off. | B65B 55/02 |
| 493785 | 1/1974 | Japan . | |
| 51-153078 | 12/1976 | Japan . | |
| 54-60023 | 4/1979 | Japan . | |
| 56-23421 | 3/1981 | Japan . | |
| 56-131118 | 10/1981 | Japan . | |
| 6147323 | 3/1986 | Japan . | |
| 6258963 | 3/1987 | Japan . | |
| 2233381 | 9/1990 | Japan . | |
| 2298310 | 10/1990 | Japan . | |
| 5330515 | 12/1993 | Japan | 53/510 |

*Primary Examiner*—Lowell A. Larson
*Assistant Examiner*—Ed Tola
*Attorney, Agent, or Firm*—Webb Ziesenheim Bruening Logsdon Orkin & Hanson, P.C.

[57] ABSTRACT

In accordance with the present invention, there can be mass produced long-term preservable lunches in a short period of time, because a series of such operations as formation, cleaning, sterilizing, dishing-up, sealing and filling the lunch box with an inert gas are carried out consistently by virtue of the production unit of lunches of the present invention. Further, because the lunches are allowed to pass through successively the gas chambers filled with the inert gas, no insufficient filling of the lunches with the inert gas will occur. Further, the lunch boxes can individually be filled with the inert gas when each lunch box is provided with a sealing valve and filled with the inert gas by inserting an inert gas filling tube into said lunch box through the sealing valve. The film for sealing the lunch boxes is provided thereon with a self-sealing member, and said lunch boxes may individually be filled with the inert gas by inserting the gas filing needle into each lunch box through said self-sealing member.

10 Claims, 21 Drawing Sheets

PRODUCTION UNIT OF LONG-TERM PRESERVABLE LUNCH AND LUNCH BOX USED FOR SAID LUNCH

FIELD OF INDUSTRIAL APPLICATION

This invention relates to production units of long-term preservable lunch and to lunch boxes used for said lunch, and particularly to production units capable of mass-producing long-term preservable lunch which not only prevents itself from putrefaction but also keep its freshness, flavor and fragrance without deleterious change, and to lunch boxes used for said lunch.

TECHNOLOGICAL BACKGROUND

There are many opportunities to eat lunches in a journey, holiday resort or job site. Especially in summertime, however, from the view point of outbreak of food poisoning, the lunches must be served within a definite period of time, for example, within about six hours immediately after production thereof. Accordingly, what is meant by the foregoing is that from the standpoint of the makers who produce lunches, a certain number of lunches must be produced within a definite period of time fixed by counting backward to the lunch time, and as the result, an increase in cost of production of the lunches has been brought about and, at the same time, a plan of the mass production of lunches has been thwarted. From the standpoint of the consumers who eat lunches, on the other hand, there was such a problem that when the lunches are served in the lapse of a nice bit of time after the production of said lunches, freshness, flavor and taste of the lunches deteriorate.

Particularly, vegetables or fruits are foodstuffs, which are desirous to be kept fresh in the lunch box, generate ethylene gas when packed in said box. Accordingly, there was such a problem that when the lunches dished up with vegetables or fruits and packed in lunch boxes are allowed to stand for a long period of time after the production thereof, the aging of said lunches is accelerated by the generated ethylene gas and will deteriorate in freshness, flavor and taste.

An object of the present invention is to provide methods for mass producing long-term preservable lunches even when they are dished up with perishables such as vegetables or fruits and lunch boxes therefor.

DISCLOSURE OF THE INVENTION

Under such circumstances as mentioned above, the present inventor prosecuted intensive researches with the view of making it possible to preserve lunches for a long period of time to a certain extent, and he has eventually found methods through which lunches can basically be preserved for a long period of time by filling a film-sealed lunch box with an inert gas and preserving the foodstuffs packed in said box in the inert gas atmosphere at a temperature below than the prescribed temperature, wherein there can be controlled not only oxidation and breathing action of the foodstuffs of the lunch but also evaporation of water contained in said foodstuffs and, as the result, the foodstuffs are prevented from putrefaction and also deterioration of freshness, flavor and fragrance.

The first one of the methods of the present invention as referred to above is to carry by means of a conveyor a lunch box containing dished-up foodstuffs while passing said lunch box through a stand-by chamber filled with an inert gas, followed by sealing said lunch box with a film in a sealing chamber filled with an inert gas and kept at a temperature below the prescribed temperature.

The second one of the methods of the invention is such that after the lunch box is filled with an inert gas in the stand-by chamber used in the first method mentioned above, the lunch box is sealed with a film in a sealing and cooling chamber filled with an inert gas while cooling said lunch box at a temperature lower than −1° C.

The third one of the methods of the invention is such that in the sealing and cooling chamber of the second method mentioned above, the lunch box is cooled at a cooling temperature below −8° C.

The lunches thus produced can be preserved for an extended period of time without deterioration in freshness or the like of said lunches by preserving them at a temperature below 5° C.

Hereinafter, units for producing long-term preservable lunches and lunch boxes useful therefor of the present invention are illustrated.

The production unit of the long-term preservable lunches of the invention are characterized by including a vacuum forming mechanism of preparing a lunch box by vacuum forming technique from a sheet; a cleaning-sterilizing mechanism of cleaning and sterilizing the thus formed lunch box; a dishing up mechanism of dishing up the thus cleaned and sterilized lunch box with foodstuffs; a sealing mechanism of sealing the lunch box thus dished up with the foodstuffs so that the upper side of said lunch box is covered with a covering material; and a deaerating-inert gas filling mechanism of deaerating the thus sealed lunch box and simultaneously filling said lunch box with an inert gas.

By virtue of preservation of foodstuffs in an inert gas atmosphere within the lunch box filled with the inert gas in the manner now described, oxidation and breathing action of said foodstuffs can be controlled and also evaporation of water contained in said foodstuffs can be controlled, and as the result, it is possible to mass produce long-term preservable lunches while preventing putrefaction of the foodstuffs contained in the lunch box and causing no deterioration of freshness, flavor and fragrance of said foodstuffs.

In another aspect of the present invention, the production unit of the lunches of the invention is characterized by comprising a plurality of inert gas chamber partitioned with air curtains and arranged successively in one direction; a conveyance means of conveying a large number of lunches dished up with foodstuffs successively through a plurality of the above-mentioned inert gas chambers; a filling means of filling each inert gas chamber with the inert gas so that a plurality of the above-mentioned inert gas chambers, in which the lunch boxes are conveyed, are each filled with the inert gas increasing in concentration successively and stepwide in order of remoteness of location of each chamber, and a sealing device of sealing each lunch box in the inert gas chamber having the highest inert gas concentration.

In the present invention, the inert gas concentration in lunch boxes may be increased successively by conveying said lunch boxes in a plurality of inert gas chamber increased in concentration of the inert gas successively and stepwise, and in the inert gas chamber having the highest inert gas concentration, the air in the lunch boxes may be replaced completely with the inert gas, whereby the lunch boxes thus filled with the inert gas may be sealed in the situation by the sealing means. Accordingly, a large number of lunch boxes can be filled continuously and quickly with the inert gas, and are free from insufficient filling of the inert gas. Thus, long-term preservable lunches can be mass produced.

The lunch boxes of the present invention to be dished up with foodstuffs and then sealed with a film, which are designed to be capable of being filled with an inert gas by means of an inert gas filling tube, are characterized in that said lunch box is provided with a sealing valve, which makes it possible to fill said lunch boxes with the inert gas by means of the inert gas filling tube inserted through said sealing value into said lunch boxes while keeping said lunch boxes airtight, and that said sealing valve makes it possible to keep said lunch boxes airtight when the inserted inert gas filling tube is withdrawn therefrom.

In the lunch boxes of the invention having such sealing valves as mentioned above, the lunch boxes can be filled with the inert gas without causing a gas leak by inserting the inert gas filling tube into said sealing valve, and after filling the lunch box with the inert gas, the lunch box is kept airtight, and no inert gas thus filled will not leak therefrom even when the inert gas filling tube is withdrawn from the sealing valve. In the manner explained above, the lunch boxes can be filled with the inert gas by a very simple filling operation, and hence this filling operation may be terminated in a very short of time (e.g. several seconds), resulting in success of the mass production of long-term preservable lunches.

The lunch box with a film of the present invention is characterized in that the film is provided with a self-sealing member which makes it possible to fill the lunch box with an inert gas through an inert gas filling needle inserted into said lunch box through the self-sealing member while keeping the lunch box airtight, and makes it possible to keep said lunch box airtight when the inert gas filling needle is withdrawn therefrom.

Further, the lunch box with a film of the present invention is characterized in that the film is formed from a laminated film obtained by laminating alternately a self-sealing layer as the first layer with other resin layer as the second layer, said laminated film being capable of filling the lunch box with an inert gas through an inert gas filling needle inserted into said lunch box while keeping the lunch box airtight, and of keeping the lunch box thus filled airtight when said inert gas filling needle is withdrawn therefrom.

As shown in the above-mentioned embodiments of the lunch box with a film of the present invention, the film is provided with a self-sealing member or is formed from the self-sealing first layer and, therefore, the lunch box can be filled with the inert gas without a gas leak when the inert gas filling needle is inserted into said lunch box through the self-sealing member or self-sealing film, and even when the inert gas filling needle is withdrawn therefrom, the lunch box is kept airtight and no gas leak therefrom is brought about. In this manner, the lunch box can be filled with the inert gas by a very simple operation which may be terminated in a very short period of time (e.g. several seconds) and, accordingly long-term preservable lunches can be mass produced.

The lunch box of the present invention, which is dished up with foodstuffs, is characterized in that said lunch box is provided with an inert gas filling section capable of filling the lunch box with an inert gas, and an adsorption means of adsorbing ethylene gas generated from specific one or ones out of the foodstuffs dished up.

In the present invention, the lunch box sealed with a film, in which foodstuffs are dished up, can be filled with an inert gas, thereby preserving the foodstuffs in an inert gas atmosphere. On that account, oxidation and breathing action of the foodstuffs can be controlled and also evaporation of water contained in said foodstuffs can be controlled and, as the result, the foodstuffs can be preserved for a long period of time while preventing the preserved foodstuffs from putrefaction and also causing no deterioration of said foodstuffs in freshness, flavor and fragrance.

In the invention, moreover, the lunch box has an adsorption means of adsorbing ethylene gas generated from the foodstuffs (vegetables and fruits) and the adsorbed ethylene gas can be removed from the lunch box, whereby the vegetables and fruits can maintain their freshness at a sufficiently satisfactory level. Thus, the lunch boxes of the present invention are excellent in good preservation of the vegetables and fruits contained therein.

Furthermore, the lunch boxes of the invention, which have been sealed with a film, dished up and filled with an inert gas, are characterized in that said lunch boxes are provided with a receiving bag which receives fruits and vegetables thereinto and which is equipped with an adsorption means for adsorbing ethylene gas generated from said fruits and vegetables.

Because of the adsorption means of adsorbing ethylene gas generated from the received fruits and vegetables, the ethylene gas can be removed from the receiving bag, whereby the fruits and vegetables received in the receiving bag can maintain their freshness at a sufficiently satisfactory level. Moreover, the fruits and vegetables as harvested are received in the receiving bag, and ethylene gas generated from said fruits and vegetables can be removed properly. Thereafter, the receiving bag containing the fruits and vegetables, from which the ethylene gas adsorbed has been removed, is disposed suitably in the lunch box.

Accordingly, the breathing action of fruits and vegetables, for which freshness is required particularly, can be controlled from the point of time at which the fruits and vegetables have been harvested, and when these fruits and vegetables are dished up in the lunch box, they can be preserved for an extended period of time, preventing effectively change in quality, putrefaction and deterioration thereof. Further, it is needless to say that because the lunch box is filled with an inert gas, foodstuffs other than the fruits and vegetables can also be preserved for a long period of time while preventing putrefaction, thereof and causing no deterioration in freshness, taste and fragrance thereof.

PREFERRED EMBODIMENT OF THE INVENTION

The production unit of long-term preservable lunches and lunch boxes therefor according to the present invention are illustrated below in detail.

Figure 1:
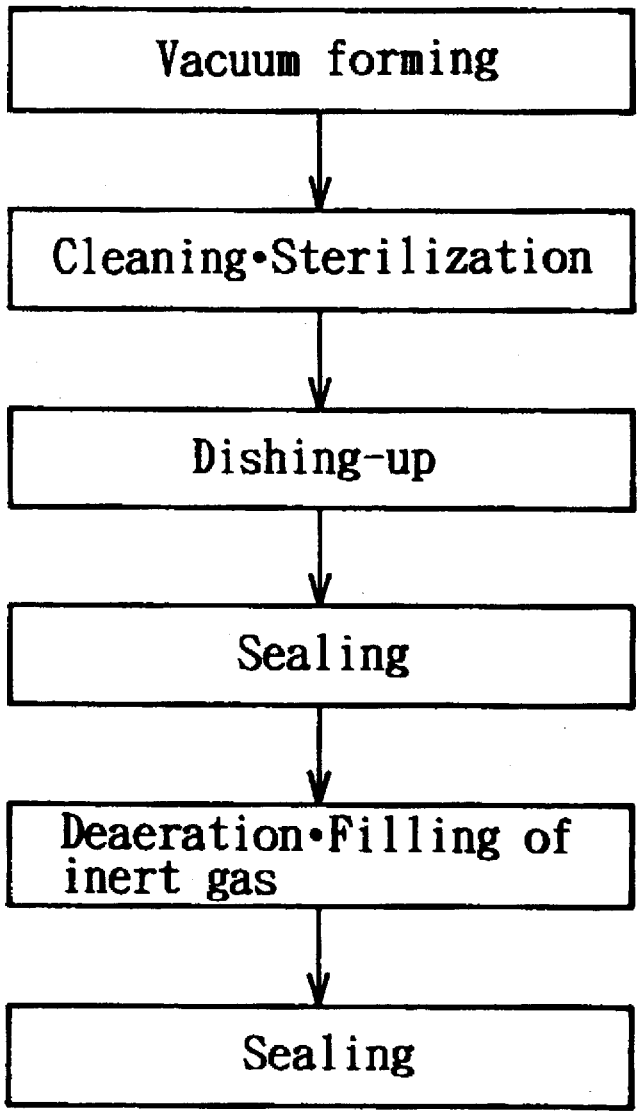
FIG. 1 is a block diagram of the production unit of long-term preservable lunch box according to the first embodiment of the present invention.

FIG. 1 is a block diagram of the production unit of long-term preservable lunches according to the first embodiment of the invention.

In this embodiment, a lunch box is first prepared by means of a vacuum forming mechanism (not shown). That is, a great number of lunch boxes 1 are prepared by applying a thin resin sheet or film to a mold having the same shape as that of the lunch box 1, followed by drawing a vacuum. For example, the lunch box 1 may be prepared at a rate of about 10 box/sec. The lunch boxes thus vacuum formed may be linked together in a row consisting of a plurality of boxes, or may be separated from one another. When the lunch boxes are linked together in the above-manner, they are separated from one another by means of a suitable cutting means.

Figure 2:
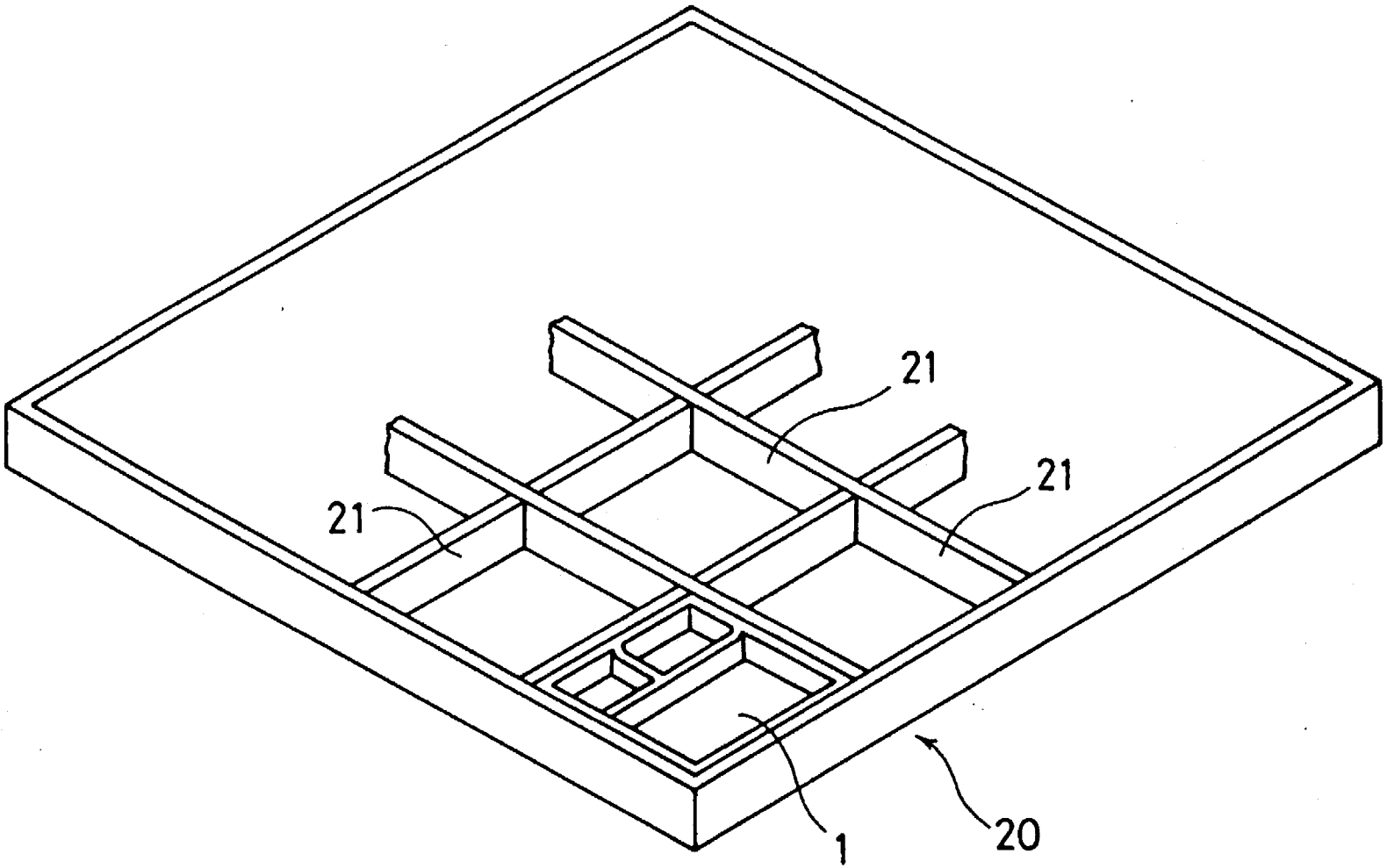
FIG. 2 is an oblique view of a pallet used in the first embodiment of the invention.

A pallet 20 shown in FIG. 2 is charged with the lunch boxes 1 thus prepared is conveyed by means of a belt conveyor. That is, the pallet 20 used in this embodiment is provided with a latticed retainer 21, and is designed that the lunch box 1 is received and retained in this retainer 21. The shape of this pallet 20 may be altered according to that of the lunch box 1, and the material from which the pallet 20 is formed includes preferably those of resins from the practical viewpoint of lightness in weight.

Subsequently, the lunch box 1 loaded upon this pallet 20 is washed and sterilized while being conveyed by a belt conveyor. In the washing sterilizing mechanism, there may be used known devices. In this embodiment, however, the washing sterilizing mechanism must be those capable of satisfying such requirement as washing and sterilizing a great number of lunch boxes in a short period of time.

Figure 3:
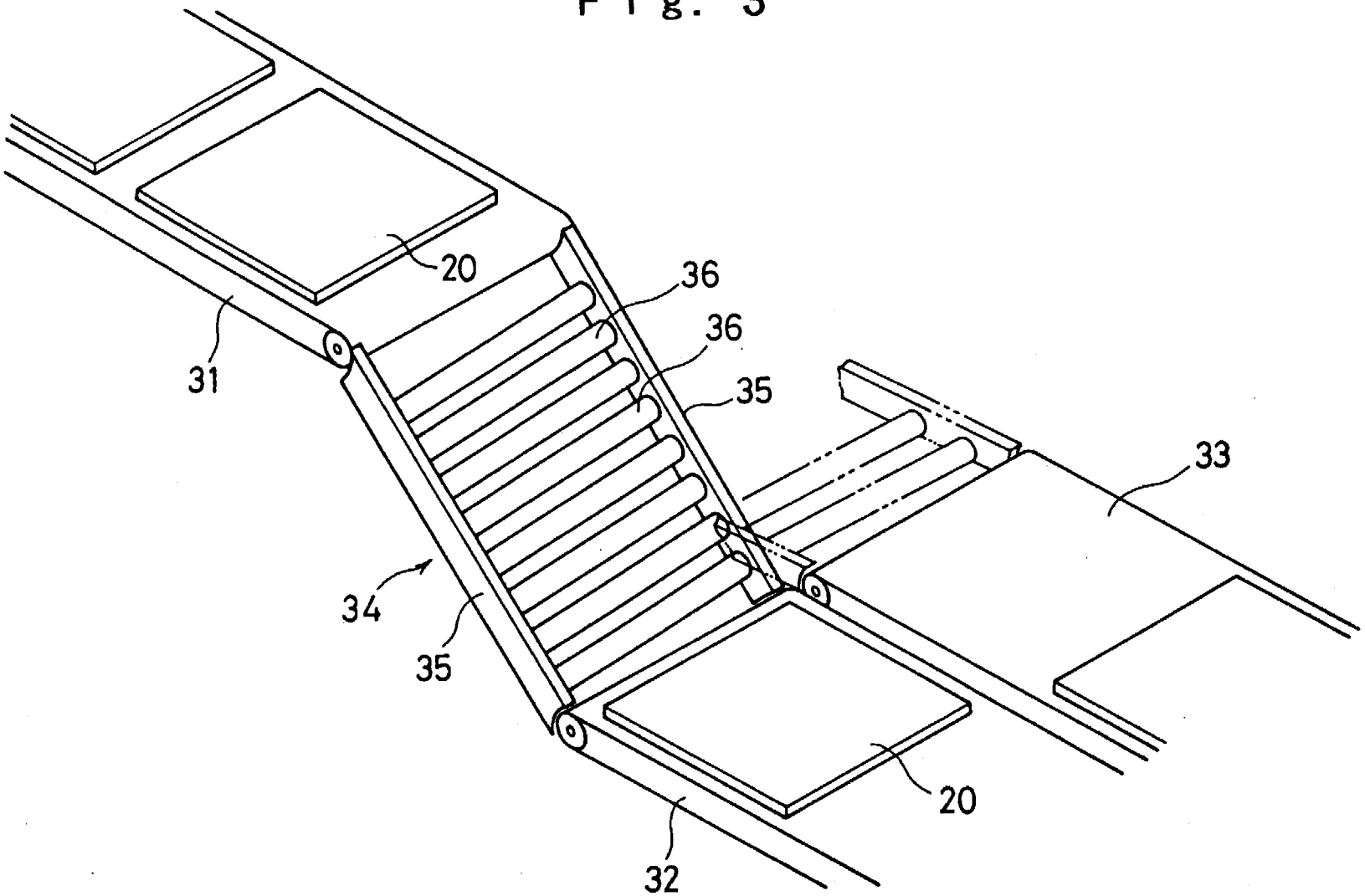
FIG. 3 is an oblique view of a conveyer for conveying the pallet shown in FIG. 2.

Then, as shown in FIG. 3, the pallet 20 being conveyed by a belt conveyer 31 is transferred onto other two belt conveyors 32 and 33, and foodstuffs are dished up on each lunch box retained in the pallet 20 being conveyed on the belt conveyors 32 and 33. The foodstuffs may be dished up by means of an automated device or by manual labor. For example, boiled rice and solid food (e.g. fries and dumplings) may be dished up by means of the automated device, and foodstuffs indefinite in shape (e.g. dumplings and pickles) may be dished up by manual labor.

In this embodiment, manual dishing-up operation can be carried out very easily by conveying the lunch boxes at a relatively slow speed.

That is, the belt conveyor 31 is arranged on the side of the upper tier, the two belt conveyors 32 and 33 are arranged on the side of the lower tier, and a roller conveyor 34 is arranged slantwise to that these conveyors are connected to one another.

The roller conveyor 34 has a large number of rollers 36 loose-fitted to a pair of support members 35, and the upper part of this roller conveyor 34 is pivotably fitted to the belt conveyor 31 on the side of the upper tier. The lower part of the roller conveyor 34 is detachably constructed so that when the upper part of the roller conveyor 34 is pivoted, the lower part of this conveyor 34 detaches itself from the belt conveyor 32 and attaches itself to the belt conveyor 33, and vice versa. The pivoting operation of this roller conveyor 34 is conducted by an automatic control device (not shown).

Accordingly, the pallet 20 being conveyed by the belt conveyor 31 on the side of the upper tier slides on the roller conveyor 34 when this roller conveyor 34 is connected to the belt conveyor 32 on the side of the lower tier, and the pallet 20 is transferred onto the belt conveyor 32. As shown in FIG. 3 by way of an imaginary line, on the one hand, when the roller conveyor 34 is connected to the other conveyor 33 by pivoting, the pallet 20 slides on the roller conveyor 34 and is transferred onto the other belt conveyor 33. In this manner, the pallets being conveyed by the belt conveyor 31 can be transferred alternately to the belt conveyors 32 and 33 on the side of the lower tier. When the pallets 20 are conveyed by the belt conveyors 32 and 33 on the side of the lower tier, foodstuffs are dished up by laborers on the lunch boxes 1 retained in said pallets 20.

Assuming that the three belt conveyors 31, 32 and 33 move at the same speed, the speed of the pallets 20 transferred onto the belt conveyors 32 and 33 on the side of the lower tier can be reduced to ½ of the pallet 20 on the belt conveyor 31 on the side of the upper tier, and accordingly the speed of the lunch boxes retained by the pallets 20 can also be reduced likewise.

In the present invention as illustrated above, the conveying speed of the pallet 20 charged with the lunch boxes 1 can be changed freely and, therefore, the dishing up of foodstuffs on the lunch boxes can be accomplished very easily.

Figure 9:
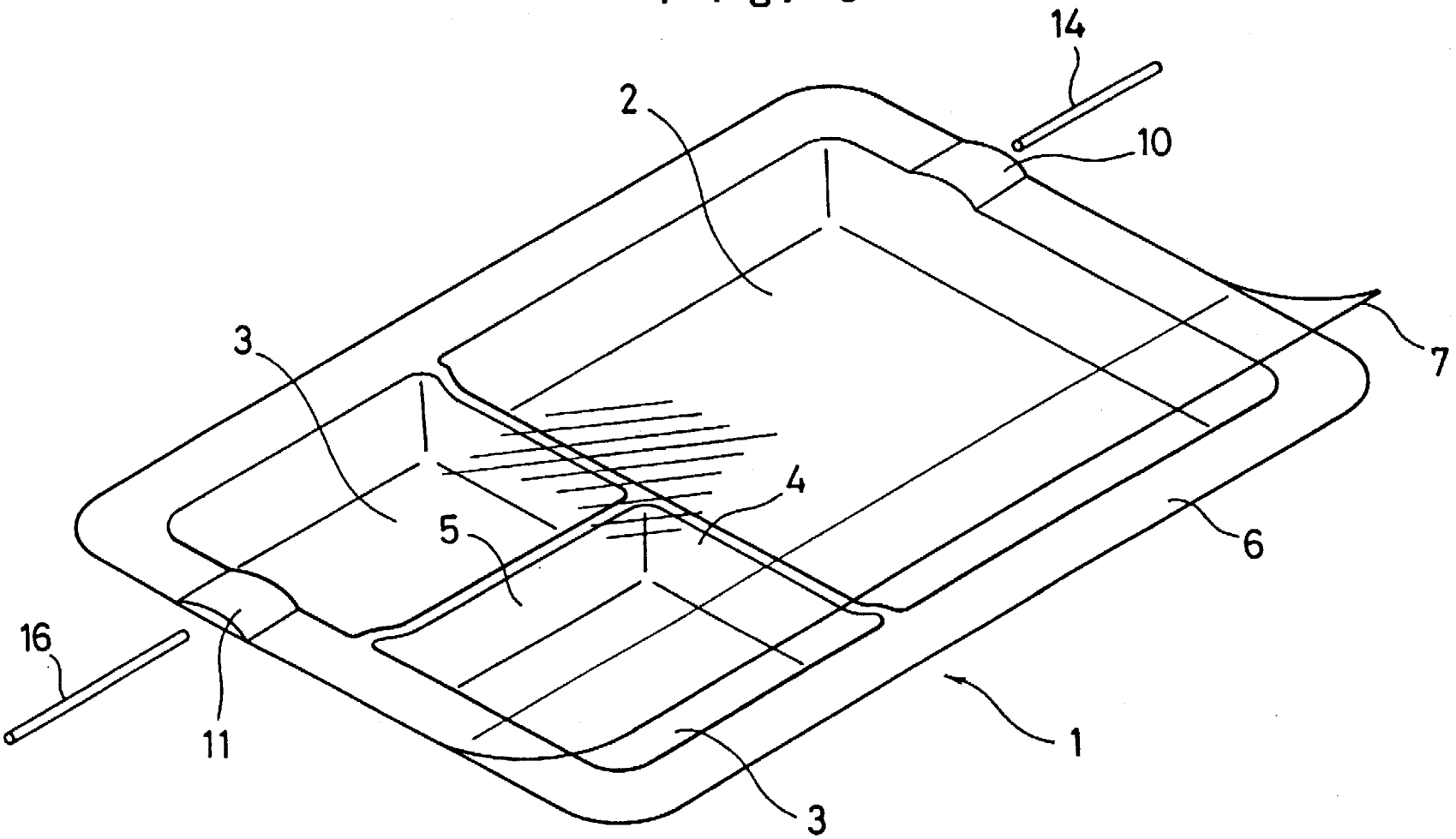
FIG. 9 is an oblique view of a lunch box according to the third embodiment of the invention.
Figure 10:
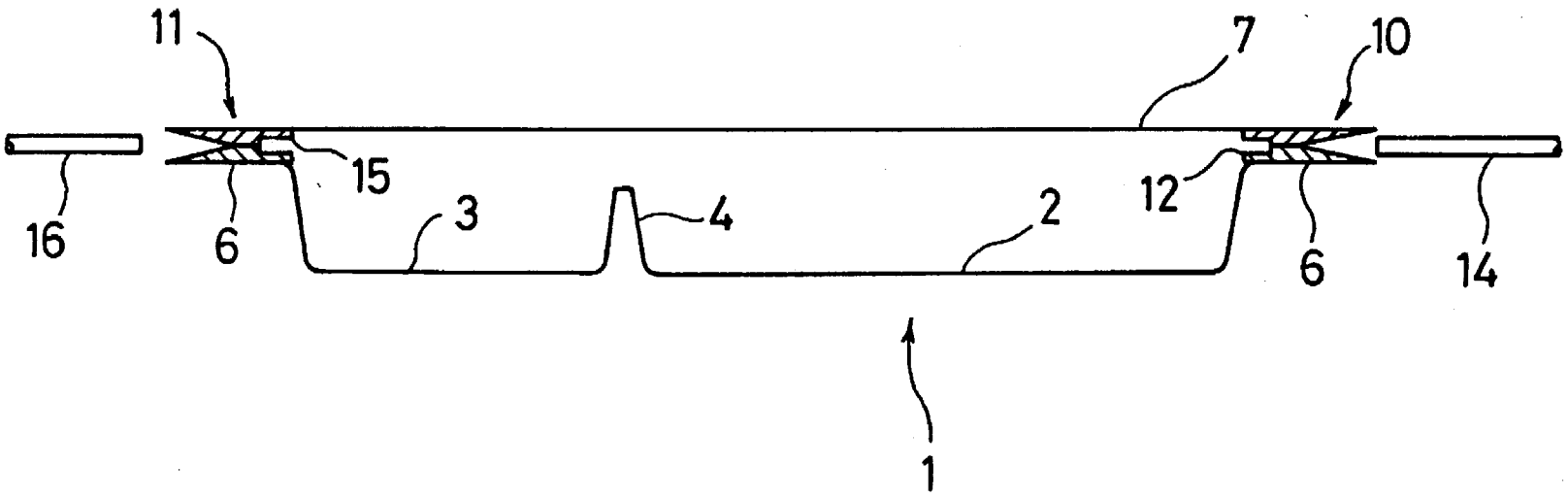
FIG. 10 is a cross section of the lunch box shown in FIG. 9.
Figure 11:
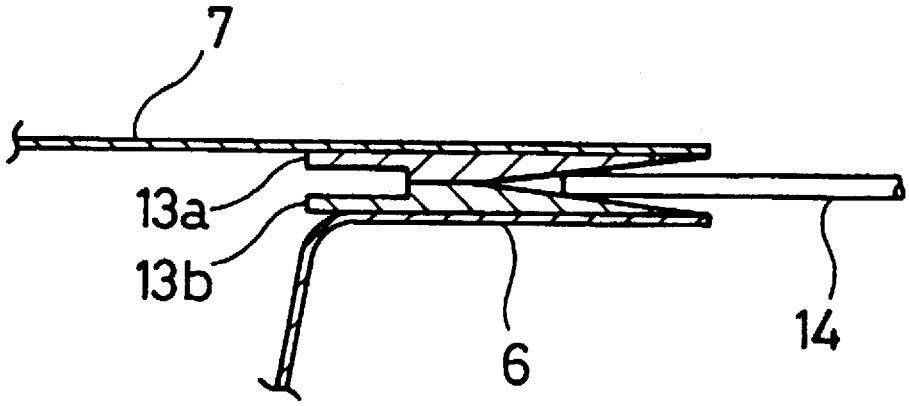
FIG. 11 is an enlarged cross section of the sealing valve shown in FIG. 10.

Subsequently, the lunch box 1 thus dished up is sealed with a film 7 as shown in FIGS. 9–11 of the third embodiment of the invention.

Figure 4:
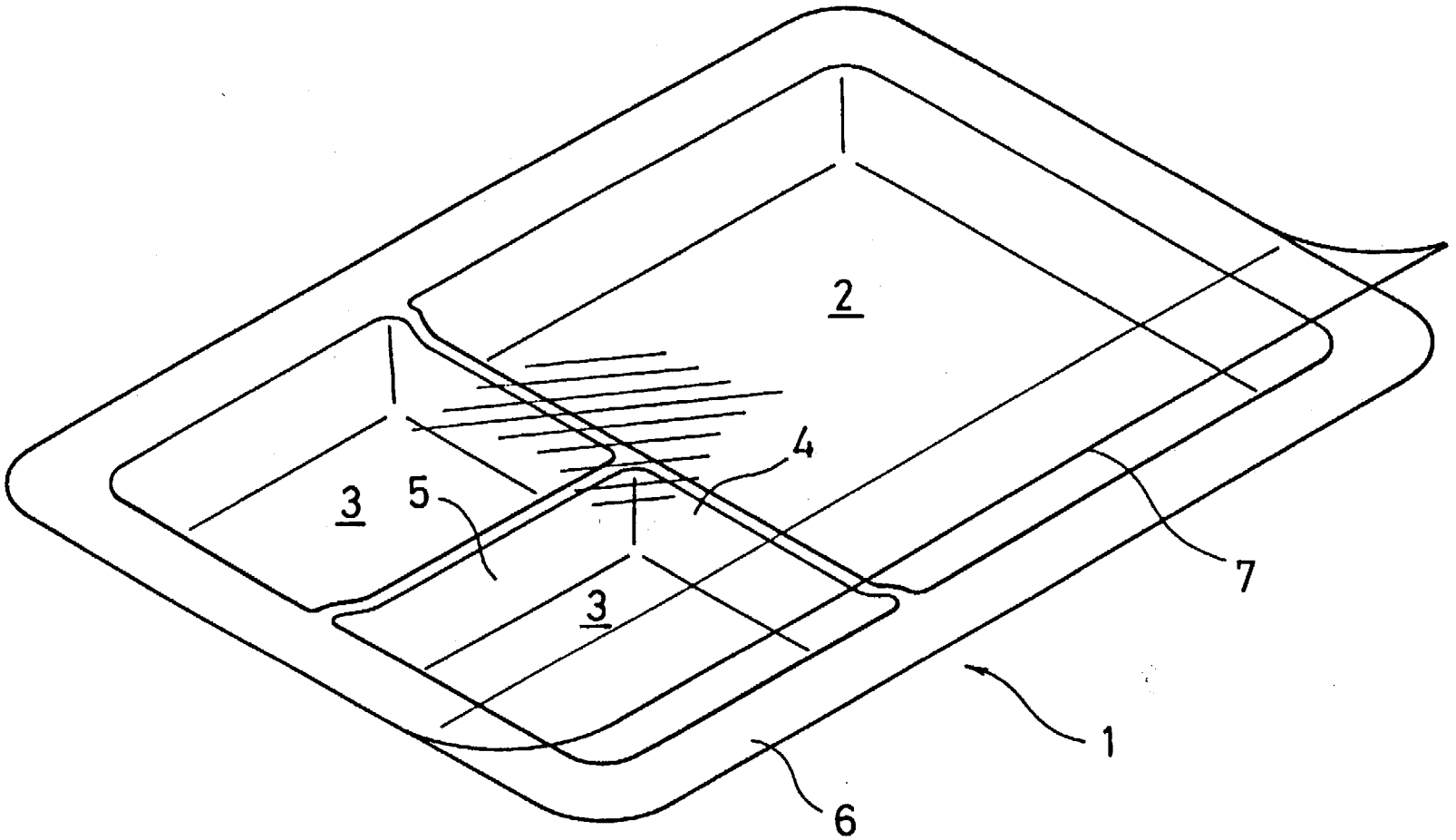
FIG. 4 is an oblique view of a lunch box used in the production unit of a lunch according to the second embodiment of the invention.

The lunch box 1 of this embodiment of the invention comprises a main dish section 2 in which boiled rice is dished up and side dish sections 3 in which side dishes such as fried or broiled food or salad is dished up as shown in FIG. 4. The main dish section 2 is partitioned from the side dish sections 3 by a wall 4 risen from the bottom of the lunch box 1, and similarly the side dish sections are partitioned by a wall 5. These walls 4 and 5 are made lower in height than the side wall of the lunch box 1.

This lunch box 1 is provided with a flange 6 all over the circumference thereof. This flange 6 is sealed with a film 7 by means of a sealing mechanism (now shown) so that the upper face of the lunch box 1 is covered with this film 7.

This film 7 used herein includes preferably those which are low in permeability to oxygen and excellent in safety, for example, polyethylene film, polypropylene film, polyester film or Pluran film. Of these films, particularly preferred is Pluran film which is formed from polysaccharides which are water-soluble, not gel-forming and viscous, and this film has such characteristics that it is edible and, moreover, is low in permeability to oxygen. Moreover, this Pluran film has such an advantage that is excellent in sealing properties as evidenced by its adhesion to the lunch box 1. Further, this Pluran film has also such an advantage that when the lunch box 1 sealed with this Pluran film is warmed up by heating, labor necessary for removing this film from the lunch box 1 can be saved.

Subsequently, the lunch box 1 thus sealed is deaerated simultaneously charged with an inert gas.

In this embodiment of the invention, the lunch box 1 has a sealing valve 12 as mentioned below in order that the operation of replacing the air in the great number of lunch boxes 1 with an inert gas can be effected in a short period of time.

That is, in this embodiment of the invention, the lunch box 1 is provided with an inert gas filing portion 10 for filling said lunch box 1 with the inert gas in the space where the flange 6 is sealed with the film 7, and a deaeration portion 11 for discharging the air outside the lunch box 1 at the time when the lunch box 1 is filled with the inert gas through the inert gas filling portion 10. This gas filling portion 10 and deaeration portion 11 are illustrated below with reference to FIGS. 10 and 11 shown in the third embodiment of the invention.

In the gas filling portion 10, the sealing valve 12 is fitted in between the flange 6 and the film 7. This sealing valve 12 is composed of a pair of valve bodies 13*a* and 13*b*, both being formed from a flexible resin. On that account, when an inert gas filling tube 14 connected to an inert gas supply source (not shown) is inserted into a space between the valve bodies 13*a* and 13*b*, said valve bodies 13*a* and 13*b* deflect to such an extent that the insertion thereinto of this filling tube 14 is allowed, and this filing tube 14 is surrounded intimately by said valve bodies 13*a* and 13*b*. On that account, the lunch box 1 can be filled with the inert gas through the inert gas filling tube 14 without causing gas leak from said lunch box 1. When the inert gas filling tube 14 is withdrawn therefrom, the valve bodies 13*a* and 13*b* attach to each other, thereby retaining the thus filled gas in the lunch box 1 without leaking therefrom.

Further, the deaeration portion 11 is also provided with a sealing valve 15 having the same structure as the sealing valve 12 of the gas filling portion 10. Accordingly, when a deaeration tube 16 is inserted between the valve bodies of the sealing valve 15, the air in the lunch box can be discharged through this deaeration tube 16 while being surrounded intimately by the vale bodies of the sealing valve 15. When this deaeration tube 16 is withdrawn therefrom, the sealing valve can be maintained without causing air leakage therefrom.

Accordingly, when the lunch box 1 is filled with the inert gas, the inert gas filling tube 14 and the deaeration tube 16 are inserted individually into the sealing valves 12 and 15. Thus, the lunch box 1 is maintained at a state where no gas or air leaks therefrom, because the gas filing tube 14 and the deaeration tube 16 are intimately surrounded individually by the valve bodies of the sealing valves 12 and 15. Subsequently, when the filling of the inert gas through the inert gas filling tube 14 is initiated, the air in the lunch box 1 is discharged through the deaeration tube 16. By this operation, the air in the lunch box 1 is replaced with the inert gas after the lapse of a definite period of time (several seconds). Thereafter, the filing tube 14 and deaeration tube 16 are withdrawn therefrom, and the lunch box 1 is kept airtight by means of the sealing valves 12 and 15.

In this way, the lunch box 1 can be filled with the inert gas by a very simple filling operation according to this embodiment of the invention, said operation being accomplished in a very small time (e.g. several seconds).

The long-term preservable lunches can be mass-produced by filing a sealed lunch box with an inert gas and preserving foodstuffs in an inert gas atmosphere, wherein oxidation and breathing action of the foodstuffs and also evaporation of water contained in the foodstuffs can be controlled and, as a result, the foodstuffs are prevented not only from putrefaction but also from deterioration of freshness, taste and fragrance. The inert gas used herein may be any gases so long as they are capable of controlling oxidation and breathing action of foodstuffs, for example, nitrogen gas or the like.

In this embodiment of the invention, the inert gas filling portion 10 and deaeration portion 11 of the lunch box 1 are perfectly sealed. However, the sealing of these portions is not always necessary, because no practical leakage of the inert gas takes place by the action of the sealing valves 12 and 15. Furthermore, the sealed lunch box 1 may be put into a bag (not shown), and the bag may be then filled with the inert gas, followed by sealing.

It is needless to say that this embodiment of the invention is not limited to the detailed description as mentioned above, and variations and modifications can be effected within the spirt and scope of the invention. For example, in order to further improve preservability, the dished-up lunch box may be filled with the inert gas while cooling paid lunch box to the prescribed temperature.

As stated hereinbefore, according to the first embodiment of the present invention, long-term preservable lunches can be mass-produced by filling the sealed lunch box and preserving foodstuffs in an inert gas atmosphere, wherein oxidation and breathing action of the foodstuffs and also evaporation of water contained in said foodstuffs can be controlled and, as a result, the foodstuffs are prevented not only from putrefaction but also from deterioration of freshness, taste and fragrance.

The production unit of the lunches according to the second embodiment of the invention is illustrated below with reference to the accompanying drawings.

Figure 5:
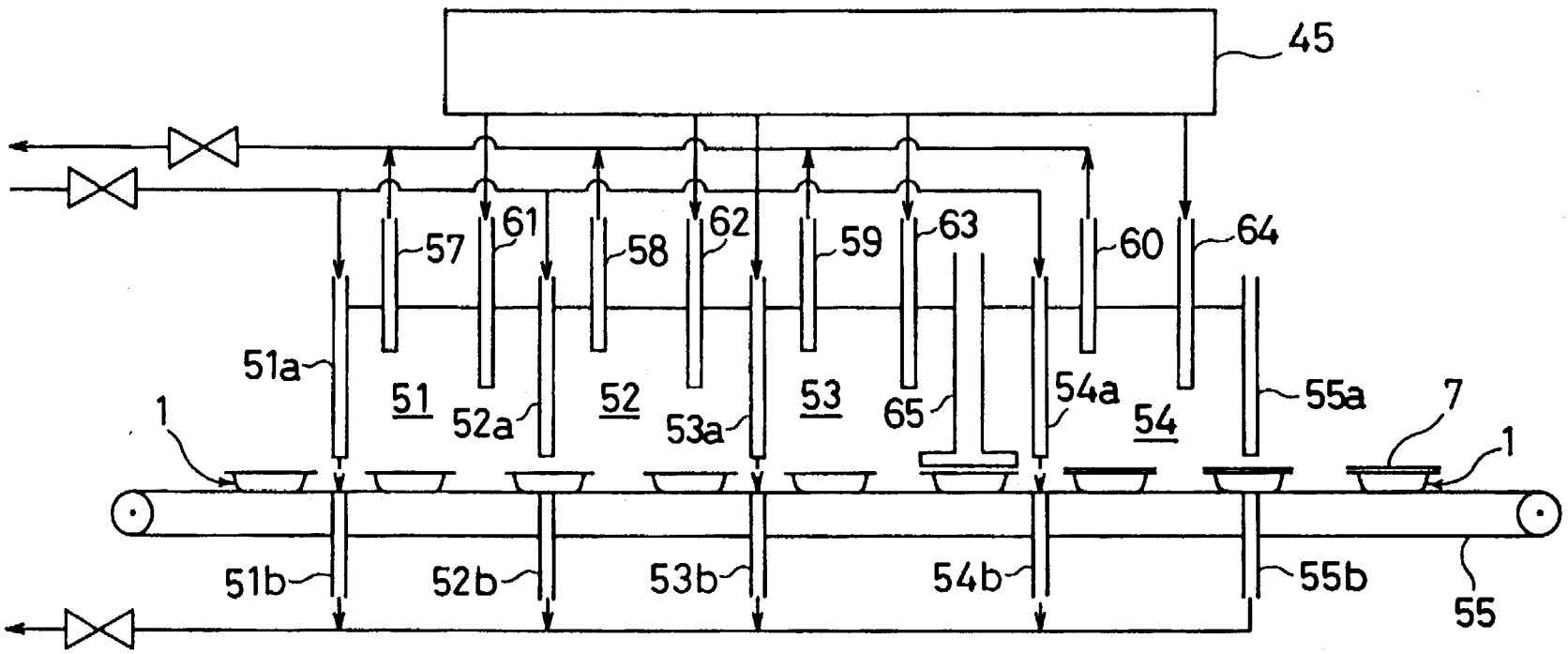
FIG. 5 is a schematic view of the production unit of a lunch according to the second embodiment of the invention.
Figure 6:
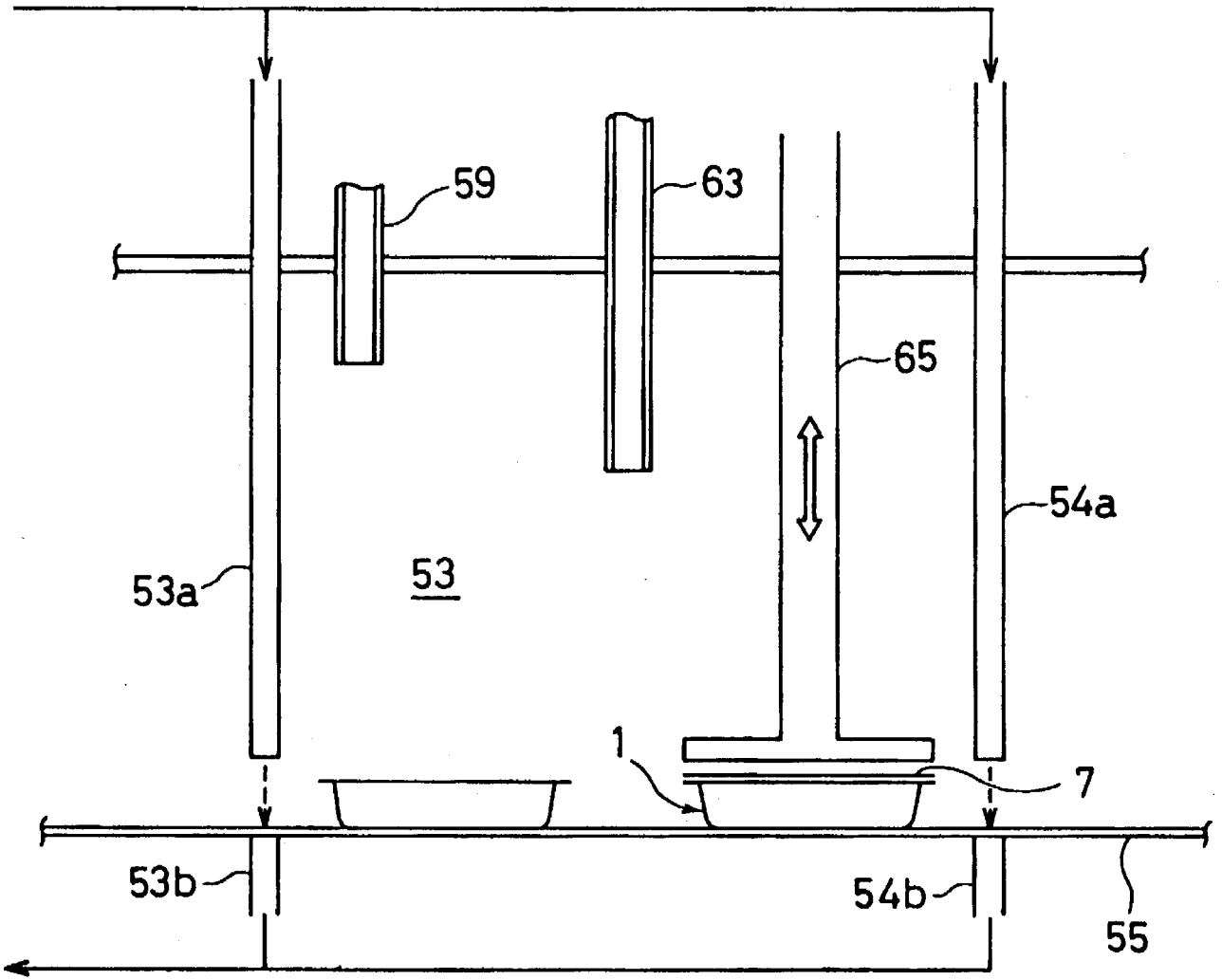
FIG. 6 is an enlarged view of a seal gas chamber shown in FIG. 5.
Figure 7:
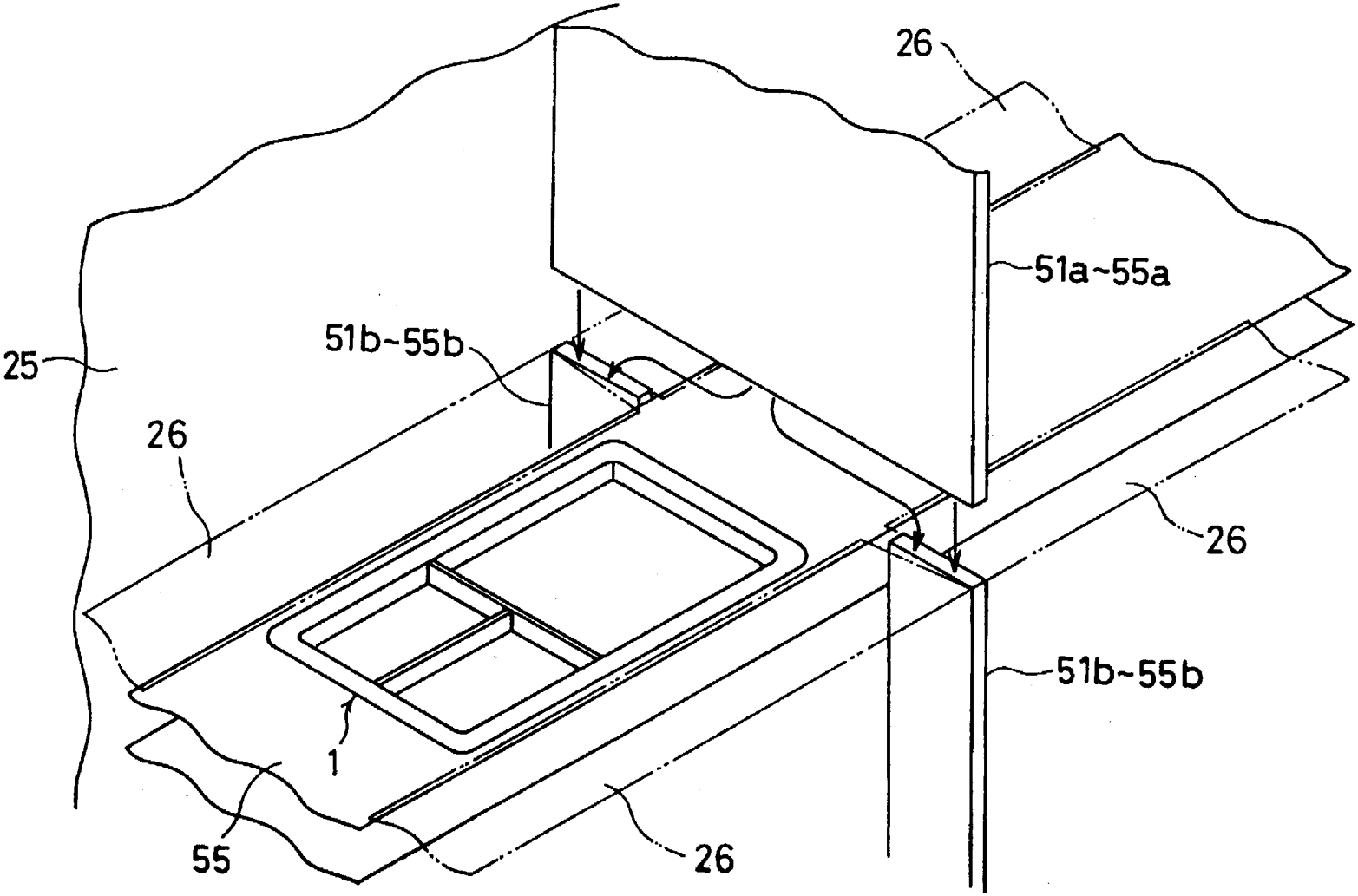
FIG. 7 is a fragmented oblique view of each gas chamber shown in FIG. 6.

FIG. 4 is an oblique view of the lunch box used in the production unit of the lunch according to this embodiment of the invention. FIG. 5 is a schematic view of the production unit of the lunch according to this embodiment of the invention. FIG. 6 is an enlarged view of a seal gas chamber shown in FIG. 5. FIG. 7 is a fragmented oblique view of each seal gas chamber.

The lunch box 1 used in this embodiment of the invention, as shown in FIG. 4, is formed from a synthetic resin, and comprises a main dish section 2 in which boiled rice is dished up and side dish sections 3 in which side disches such as fried or broiled food or salad is dished up as shown in FIG. 4. The main dish section 2 is partitioned from the side dish sections 3 by a wall 4 risen from the bottom of the lunch box 1, and similarly the side dish sections are partitioned by a wall 5. These walls 4 and 5 are made lower in height than the side wall of the lunch box 1.

In the lunch box 1, a flange 6 is formed on the outer periphery of the side wall of said lunch box 1. As will be mentioned later, after filling the lunch box 1 with the inert gas, this flange 6 is sealed with the film 7.

As shown in FIG. 5, the production unit of the lunch according to this embodiment of the invention is provided with four gas chambers 51, 52, 53 and 54 for filling said lunch box with the inert gas, and further provided with a belt conveyor 55 (conveying means) for conveying the dished-up lunch boxes successively through the gas chambers of 51 to 54.

These gas chambers 51–54 are partitioned by means of an air curtain of inert gas. That is, the gas chambers 51–54 are each provided with the first gas ventilation walls 51*a*, 52*a*, 53*a*, 54*a* and 55*a*, respectively, and further provided on the side of the belt conveyor 55 with the second gas ventilation walls 51*b*, 52*b*, 53*b*, 54*b* and 55*b*, respectively, so as to be opposite to the first gas ventilation walls 51*a*–55*a*. The inert gas is fed to the first gas ventilation walls 51*a*–55*a*, and the pressure of the first gas ventilation walls 51*a*–55*a* is increased to discharge the thus fed inert gas therefrom. Simultaneously, because the pressure of the second gas ventilation walls 51*b*–55*b* has been decreased, the discharged inert gas is sucked into the second gas ventilation walls 51*b*–55*b*. Thus, the gas chambers 51–54 may be partitioned by the stream of the inert gas.

The partitioning by the air curtain of the gas chambers 51–54 is illustrated below in more detail with reference to FIG. 7. As shown in FIG. 7, the first gas ventilation walls 51*a*–55*a* on the gas blowing side are arranged above the belt conveyor 55 so that they jut out from both sides of the belt conveyor 55. On the one hand, the second gas ventilation walls 51*b*–55*b* on the side of the sucking the inert gas are arranged at the both sides of the belt conveyor 55. Accordingly, the inert gas blown out from the center portion of the first gas ventilation walls 51*a*–55*a* flows toward both sides of the belt conveyor 55 so as to cross said belt conveyor 55 and, at the same time, the inert gas blown out from both ends of the first gas ventilation walls 51*a*–55*a*, as it is, flows downward, as shown in FIG. 7 by way of an arrow. Thus, the air curtain for partitioning the gas chambers is formed.

As can, be seen from FIG. 7, there is formed a space between the side wall 25 partitioning the gas chambers and the belt conveyor 55, and the inert gas is in danger of leaking from said space. On that account, the gas chambers 51–54 are provided with breaker strips 26, one edge of which being fixed to the side wall 25, and the other being loaded on the belt conveyer 55. These breaker strips 26 are formed from elastic materials such as rubber so that the inert gas will not leak therethrough by vibration of the belt conveyor 55. Thus, the leakage of the inert gas through the space between the side wall 25 and belt conveyor 55 can be prevented.

Figure 8:
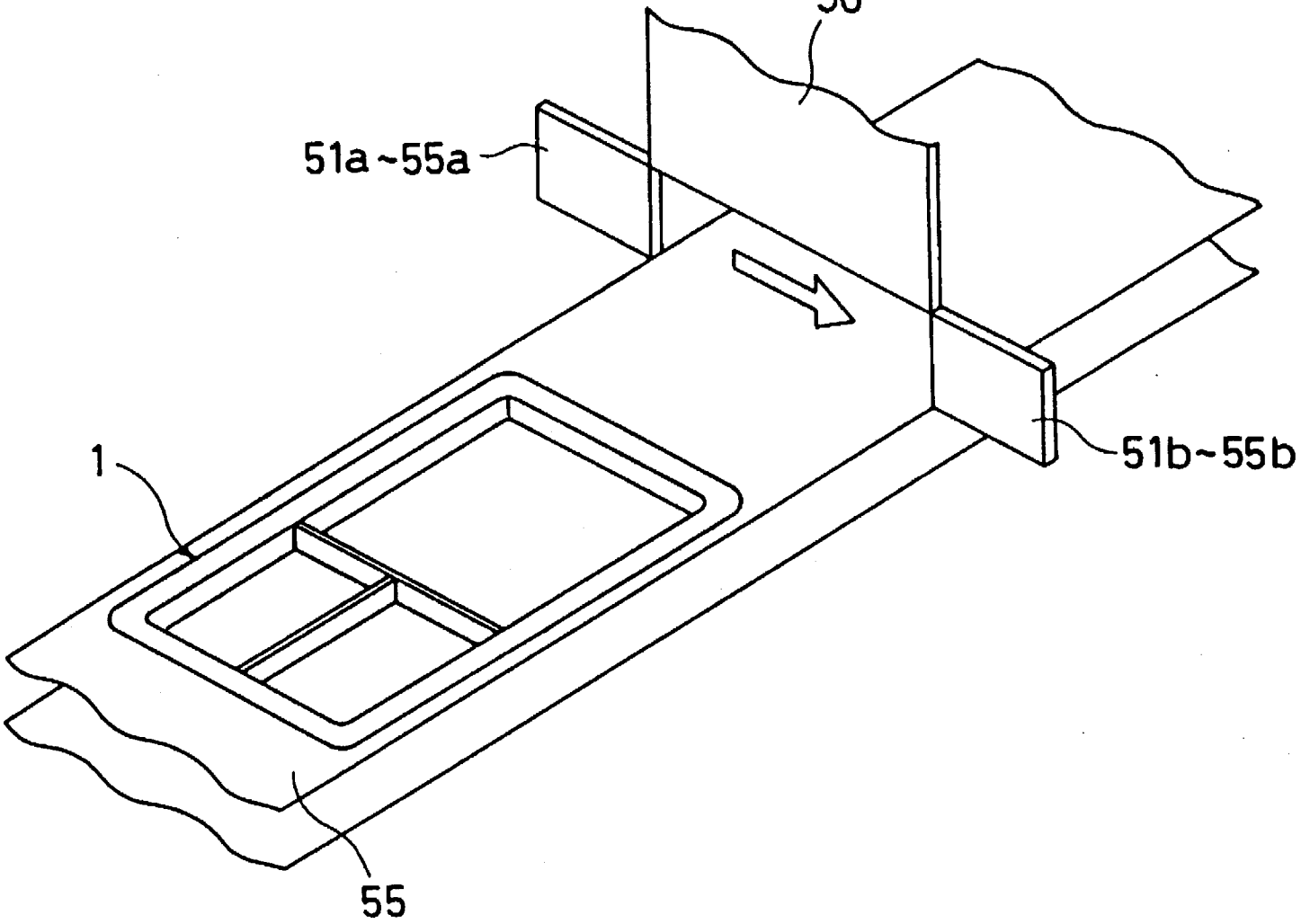
FIG. 8 is a fragmented oblique view of each gas chamber according to a modification of the second embodiment of the invention.

Further, the gas chambers 51–54 may be partitioned by the air curtain in the following manner. That is, as shown in FIG. 8, the first gas ventilation walls 51*a*–55*a* on the inert gas blowing side are arranged on one side of the belt conveyor 55, and the second gas ventilation walls 51*b*–55*b* on the inert gas sucking side are arranged on the opposite side of the conveyor belt 55. Accordingly, the inert gas blown from the first gas ventilation walls 51*a*–55*a* flows across the conveyor belt 55 in the manner as shown by an arrow in FIG. 8 and is sucked by the second gas ventilation walls 51*b*–55*b*. Thus, the gas chambers 51–54 are partitioned by means of the air curtain. In this case, the upper side of the air curtain thus formed is partitioned by the fixed plate 56.

In this second embodiment of the invention, each gas chamber is provided with an inert gas filling means so that the concentration in the gas chamber of the inert gas increases successively and stepwise as said inert gas proceeds downstream from the gas chamber 51 to the gas chamber 54. For example, the concentration in the gas chamber 51 of the inert gas is preset to 85%, that in the gas chamber 52 is preset to 95%, and that in the gas chamber 53 (gas seal chamber) is preset to the highest level, i.e. 99%. Inversely, however, the concentration in the gas chamber 54 is preset to a level lower than that in the gas chamber 53, for example, to 90%. This gas chamber 54 is provided for maintaining the gas concentration in the gas chamber 53 at a prescribed level.

The filling means are provided with suction tubes 57, 58, 59 and 60 for suction of air in each of the gas chambers 51–54 and with introducing tubes 61, 62, 63 and 64 for introduction of the inert gas into each of the gas chambers 51–54. The introducing tubes 61–64 are each connected to an inert gas dispenser 45. This inert gas dispenser 45 is to dispense the inert gases having varied concentrations to the introducing tubes 61–64, respectively. The inert gas used herein may be any gases so long as they are capable of controlling oxidation and breathing action of the foodstuffs, for example, nitrogen gas or the like.

As shown in FIG. 6, the gas chamber 53 (gas seal chamber) to be filled with the inert gas having the highest concentration is provided with a sealing device 65 (sealing means) for keeping the lunch box 1 airtight. The lunch box 1 filled with the inert gas by the inert gas atmosphere of the gas chamber 53 (gas seal chamber) having the highest inert gas concentration is sealed by means of the sealing device 65 which moves vertically.

Accordingly, the dished-up lunch box 1 can be filled with the inert gas increased successively in concentration when said lunch box is conveyed by the belt conveyor 55 through the gas chambers in which the inert gas has been increased in concentration successively and stepwise. And in the gas chamber 53 (gas seal chamber) having the highest inert gas concentration, the air present in the lunch box 1 can be completely replaced with the inert gas, whereby the lunch box 1 can be filled with the inert gas perfectly. The lunch box 1 in this state is sealed with the film 7 by means of the sealing device 65, and the thus sealed lunch box 1 is then passed through the gas chamber 54. This gas chamber 54 is provided in order to maintain the inert gas concentration in the gas chamber 53 at the prescribed level.

Thus, it is possible to fill a large number of lunch boxes with the inert gas continuously and quickly, and no insufficient filing of the inert gas will occur, thereby long-term preservable lunches can be mass-produced.

Needless to say, this embodiment of the invention is not limited to the matters mentioned above, particularly to the filling means to maintain the concentration of the gas chamber at the prescribed level and the shape of the lunch box used therein.

As stated hereinbefore, according to the second embodiment of the invention, the concentration in the lunch box of the inert gas can successively be increased by conveying said lunch box through the gas chambers in which the gas concentration has been increased successively and stepwise, and in the gas chamber having the highest inert gas concentration, the lunch box is filled with the inert gas by replacing completely the air in the lunch box with the inert gas. The lunch box 1 in this state is sealed by means of the sealing means. Accordingly, a large number of lunch boxes can be filled with the inert gas continuously and quickly without fail, hence the long-term preservable lunches can be mass produced.

The third embodiment of the present invention is illustrated below.

FIG. 9 is an oblique view of the lunch box according to the third embodiment of the invention. FIG. 10 is a cross-sectional view of the lunch box shown in FIG. 9. FIG. 11 is an enlarged cross-sectional view of the sealing valve shown in FIG. 10.

As shown in FIG. 9, the lunch box 1 of this embodiment of the invention is partitioned into a boiled rice-dishing up section 2 in which the main dish which is the boiled rice is dished up and side dish sections 3. The main dish section 2 is partitioned with a wall risen from the bottom of the lunch box 1. Similarly, the side dish sections 3 are partitioned with a wall 5 risen from the bottom of the lunch box 1. These walls 4 and 5 are designed to be lower in their height than the side wall of the lunch box 1.

The lunch box 1 of this embodiment of the invention is provided on its edge the flange 6. This flange 6 is sealed with the film 7 which will cover the upper side of the lunch box. The flange 6 of the lunch box 1 may be sealed by any sealing means so long as they are known publicly.

In the lunch box 1 accordingly this embodiment of the invention, there are provided on the mating surface between the flange 6 and film 7 a gas filling portion 10 for filling said lunch box 1 with the inert gas and a deaeration portion 11 for discharging the air present in the lunch box 1 therefrom at the time of filling of the inert gas.

The gas filling portion 10 and deaeration portion 11 are illustrated below with reference to FIGS. 10 and 11.

In the gas filling portion 10, a sealing valve 12 is introduced into between the flange 6 and film 7. This sealing valve 12 is composed of a pair of valve bodies 13*a* and 13*b* formed from a flexible resin. On that account, when an inert gas filling tube 14 connected to an inert gas supply source (not shown) is inserted into between the valve bodies 13*a* and 13*b*, these valve bodies 13*a* and 13*b* deflect only to such an extent that the insertion thereinto of this filling tube 14 is permitted, and the inert gas filling tube 14 thus inserted is surrounded intimately by these valve bodies 13*a* and 13*b*. On that account, the lunch box 1 can be filled with the inert gas through the inert gas filling tube 14 without causing leak of the gas therefrom. In the meantime, when the thus inserted inert gas filling tube 14 is removed from the sealing valve 12, the valve bodies 13*a* and 13*a* join firmly each other, thereby keeping the lunch box 1 gastight.

Further, the deaeration portion 11 is provided also with a sealing valve 15 formed in the same manner as in the sealing valve 12 of the gas filling portion 10. Accordingly, when a deaeration tube 16 is inserted into the sealing valve 15, the air present in the lunch box 1 can be discharged through the deaeration tube 16 being surrounded intimately by the sealing valve 15. In the meantime, when the thus inserted deaeration tube 16 is removed from the sealing valve 15, the lunch box 1 can be kept airtight in the same manner as in the sealing valve 12.

At the time when the lunch box 1 is filled with the inert gas, the inert gas filling tube 14 and deaeration tube 16 are inserted into the sealing valves 12 and 15, respectively. In this case, the gas or air present in the lunch box 1 will not leak out from said lunch box 1 through the sealing valves 12 and 15, because the inert gas filling tube 14 and deaeration tube 16 are surrounded intimately by the sealing valves 12 and 15, respectively. When the filling of the lunch box 1 with the inert gas through the inert gas filling tube 14 is initiated, the air present in said lunch box 1 is discharged therefrom through the deaeration tube 16. Thus, after the lapse of a definite period of time (several seconds), the air present in the lunch box 1 is replaced with the inert gas. The inert gas filling tube 14 and deaeration tube 16 are then removed therefrom, but the sealing valves 12 and 15 keep the lunch box 1 airtight.

According to this embodiment of the invention, long-term preservable lunches can be mass produced, because the lunch box 1 can be filled with the inert gas by the very simple filling operation which can be accomplished in a very short period of time (e.g. several seconds).

Further, the inert gas used herein is, for example, nitrogen gas, and other gases may also be used so long as they are capable of controlling oxidation and breathing action of the foodstuffs preserved in the lunch box 1.

The first modification of the sealing valve 12 is illustrated below with reference to FIGS. 12 and 13.

Figure 12:
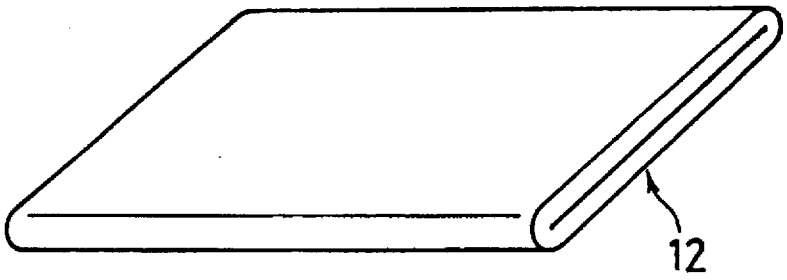
FIG. 12 is an oblique view showing the first modification of the sealing valve shown in FIG. 10.
Figure 13:
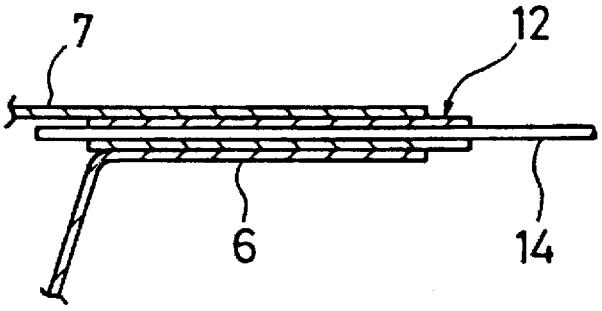
FIG. 13 is a cross section of the sealing valve shown in FIG. 12.

As shown in FIG. 12, the modified sealing valve 12 is in the form of a tube flattened by pressing, said tube being formed from a flexible resin. In this case also the inert gas filling tube 14 inserted into this sealing valve 12 is surrounded intimately by this sealing valve 12 which will deflect only to such an extent that the insertion thereinto of the inert gas filling tube 14 is permitted. Accordingly, the lunch box 1 can be filled with the inert gas through the inert gas filling tube 14 without leaking the gas therefrom. In the meantime, when the gas filling tube 14 is removed therefrom, the sealing valve 12 returns to its former state and the lunch box 1 can be kept airtight.

Figure 14:
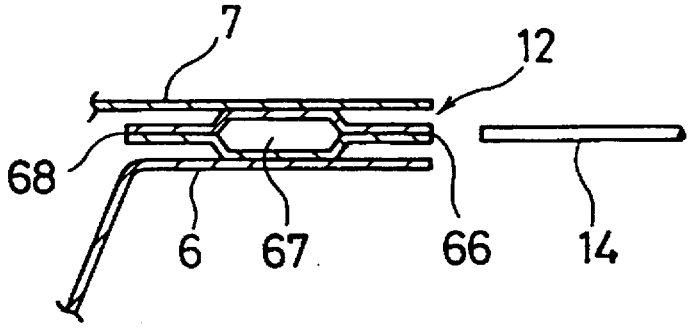
FIG. 14 is a cross sectional view showing the second modification of the sealing valve shown in FIG. 10.

Further, the second modification of the sealing valve 12 is illustrated below with reference to FIG. 14.

This modified sealing valve 12 comprises an inlet side sealing portion 66, a gas chamber 67 and an outlet sealing portion 68, said sealing valve 12 being formed from a flexible resin. The inert gas filling tube 14 inserted into the inlet side sealing portion 66, which will deflect only to such an extent that the insertion thereinto of the filling tube 14 is permitted, is surrounded intimately by the inlet side sealing portion 66, and the point of the filling tube 14 is thrusted and retained within the gas chamber 67. Under this state, when the filling of the lunch box 1 with the inert gas through the filling tube 14 is initiated, the outlet side sealing portion 68 opens and the lunch box 1 can be filled with the inert gas through the filling tube 14. In that case, the degree of flexibility of the inlet side sealing portion 66 is preset so that said sealing portion 66 remains closed. In the meantime, when the filling tube 14 is removed therefrom, both sealing portions 66 and 68 will remain closed, and the lunch box 1 thus filled with the inert gas can be kept gastight. Because the inert gas filling operation can be accomplished in a very simple manner and in a very short period of time (e.g. several seconds) as mentioned above, long-term preservable lunches can be mass produced.

Needless to say, this embodiment of the invention is not limited to the matters mentioned above, but may be subjected to various modifications.

As stated hereinabove, according to the third embodiment of the invention, the lunch box 1 can be filled with the inert gas by insertion of the inert gas filling tube into the sealing valve without leaking said inert gas therefrom, while after removal of the inert gas filling tube from the sealing valve, the lunch box is kept gastight, causing no leak of the gas. In this manner, the long-term preservable lunches can be mass produced, because the lunch box can be filled with the inert gas by a very simple filling operation which can be carried out in a short period of time (e.g. several seconds).

The fourth embodiment of the invention is illustrated below in detail.

Figure 15:
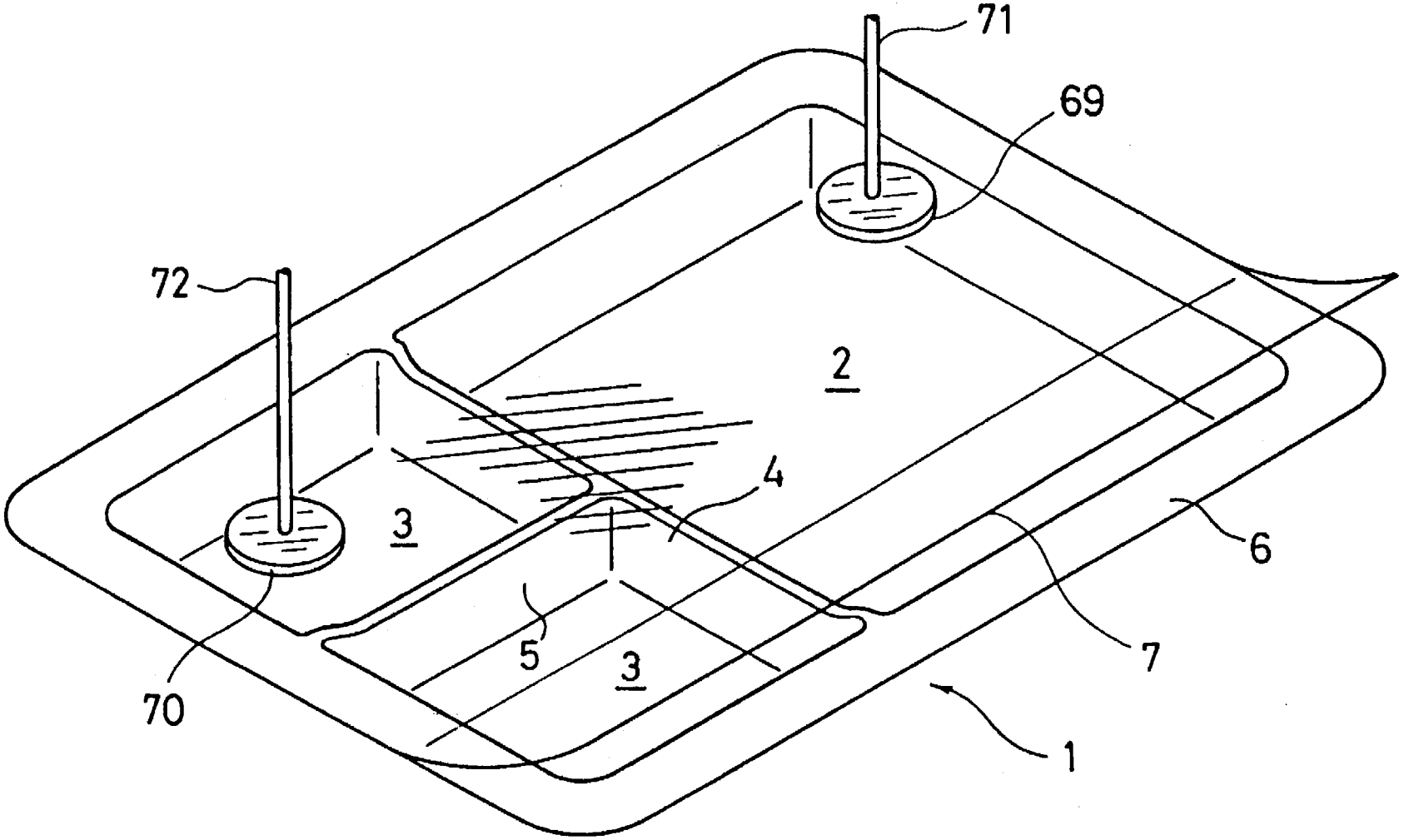
FIG. 15 is an oblique view of a lunch box according to the fourth embodiment of the invention.
Figure 16:
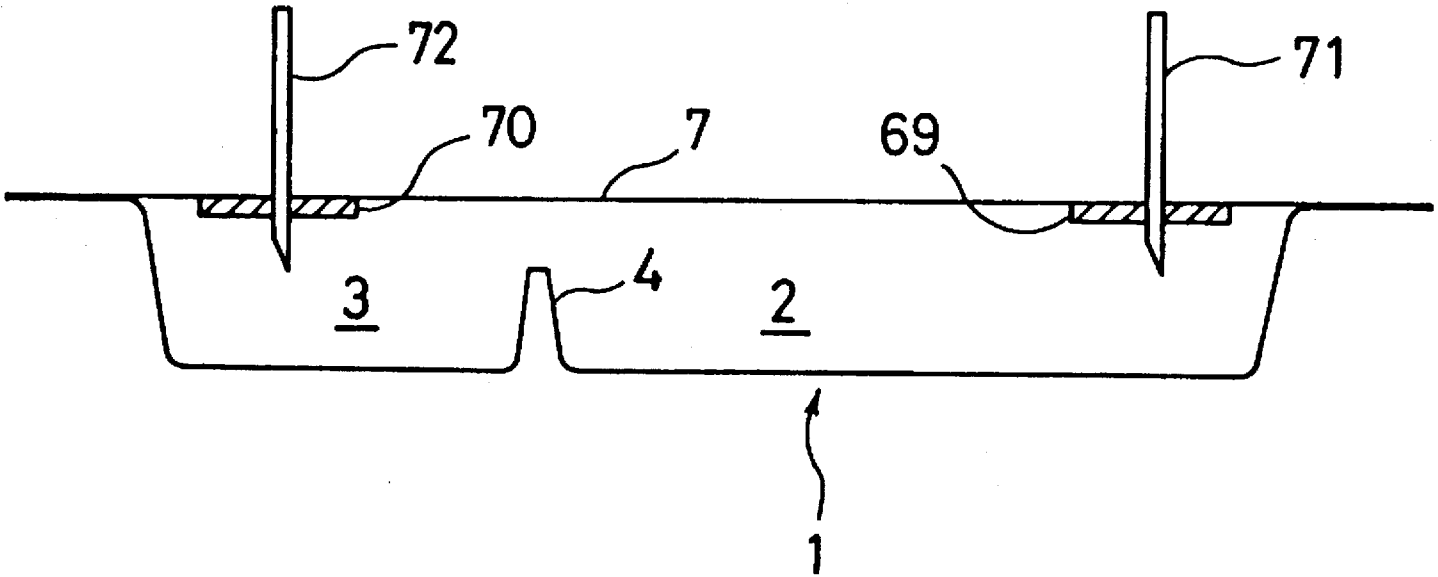
FIG. 16 is a cross section of the lunch box shown in FIG. 15.
Figure 17:
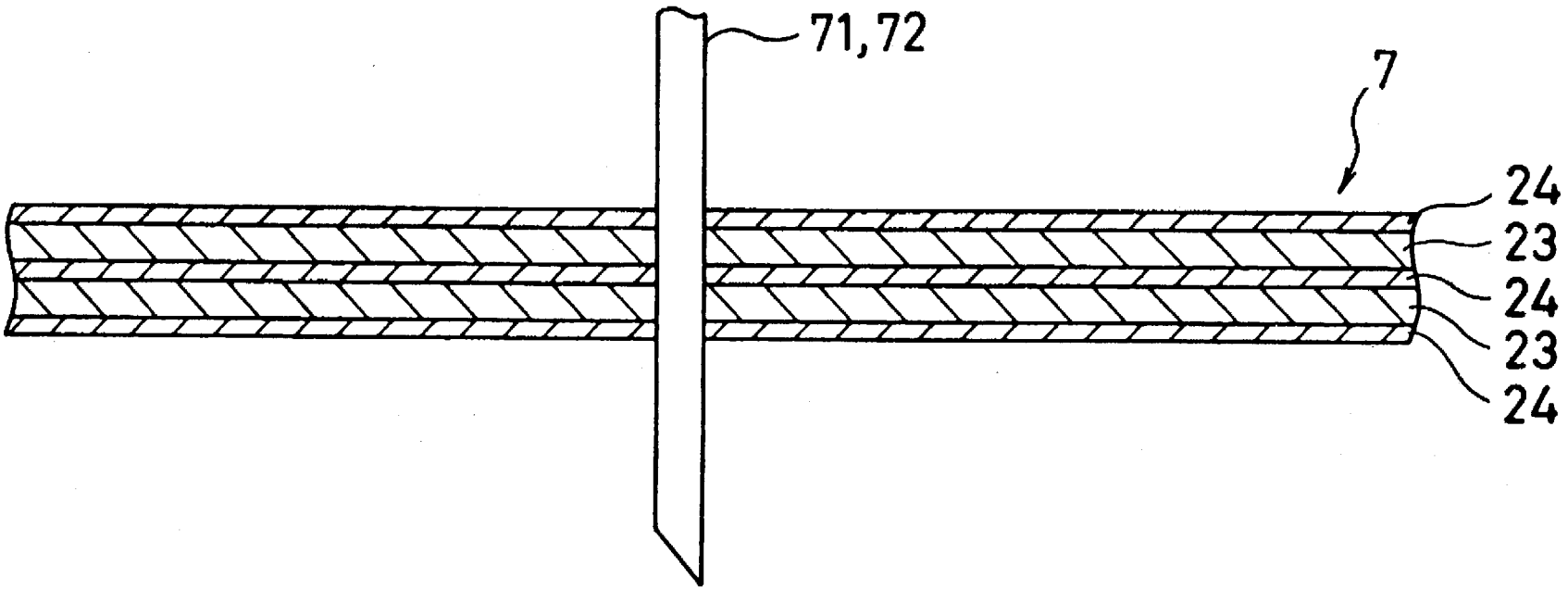
FIG. 17 is a cross section of a film according to the fourth embodiment of the invention.

FIG. 15 is an oblique view of the lunch box in accordance with the fourth embodiment of the invention. FIG. 16 is a cross-sectional view of the lunch box shown in FIG. 15. FIG. 17 is a cross-sectional view of the film in accordance with the fourth embodiment of the invention.

As shown in FIG. 15, the lunch box 1 of the fourth embodiment of the invention comprises a section 2 for dishing up a boiled rice which is a main dish and sections 3 for dishing up side dishes such as auxiliary articles of diet and salad. The main dish section 2 is partitioned by a wall 4 risen from the bottom wall of the lunch box 1, and similarly the side dish sections 3 are partitioned by a wall 5 risen from the bottom wall of the lunch box 1. These walls 4 and 5 are designed to be lower in height than that of the side wall of the lunch box 1.

The lunch box 1 according to this embodiment of the invention is provided a flange 6 on its edge, and this flange 6 is sealed on a film 7. The film 7 may be sealed by any known sealing means.

In this embodiment of the invention, the film 7 is provided with self-sealing members 69 and 70. The self-sealing member 69 keeps the lunch box 1 airtight when an inert gas filling needle 71 is inserted into said member 69, and the lunch box 1 can be filled with the inert gas through this filling needle 71, and when this filling needle 71 is drawn from said self-sealing member 69, the lunch box 1 is kept gastight.

The self-sealing member 69 is formed from a material low in hardness and having stickiness, and when the safety of food is taken into account, such material includes photosensitive adhesive materials, silicone rubber and silicone gel.

Similarly, the self-sealing member 70 is provided on the film 7 is provided in order to carry out deaeration of the lunch box 1 when said lunch box 1 is filled with the inert gas, and when a deaeration needle 72 is inserted into said self-sealing member 70, the lunch box 1 is kept airtight. In the meantime, when the deaeration needle 72 is withdrawn therefrom, the lunch box 1 is kept gastight. The self-sealing member 70 is also formed from the same materials as in the case of the self-sealing member 69.

Accordingly, at the time when the lunch box 1 is filled with the inert gas, the inert gas filling needle 71 and the deaeration needle 72 are inserted into the self-sealing members 69 and 70, respectively. The inert gas filling needle 71 and the deaeration needle 72 are surrounded intimately by the self-sealing members 69 and 70, respectively, the gas and air will not leak through the self-sealing members 69 and 70. Then, the lunch box 1 begins to be filled with the inert gas through the inert gas filling needle 71, and the air present in said lunch box 1 is discharged therefrom through the deaeration needle 72. By this operation, the air present in the lunch box 1 is replaced with the inert gas after lapse of a definite period of time (several seconds). Thereafter, when the filling needle 71 and deaeration needle 72 are withdrawn therefrom, the lunch box 1 can be kept gastight by means of the self-sealing members 69 and 70.

In this manner, the lunch box 1 can be filled with the inert gas by a very simple filling operation according to this embodiment of the invention, hence this filling operation can be accomplished in a very short period of time (e.g. several seconds). Accordingly, long-term preservable lunches can be mass produced according to this embodiment of the invention.

Further, the inert gas used herein is, for example, nitrogen gas and may also be any gases so long as they are capable of controlling the oxidation and breathing action of foodstuffs.

The modification of this embodiment of the invention is illustrated below with reference to FIG. 17.

As shown in FIG. 17, the film 7 used in this modification to cover the lunch box 1 is formed from a laminated film prepared by laminating alternately the first layer 23 with the second layer 24. The first layer 23 is formed from the above-mentioned silicone rubber or silicone gel which exhibits self-sealing properties, and the second layer 24 is a polyethylene terephthalate film.

This film 7, when the inert gas filling needle 71 is inserted into the lunch box 1 through the film 7 to fill the lunch box 1 with the inert gas, will keep the lunch box 1 airtight and makes it possible to fill said lunch box 1 with the inert gas, and in the meantime when the inert gas filling needle 71 is withdrawn therefrom, the lunch box 1 can be kept airtight. The same shall apply to the case of the deaeration needle 72 inserted into the lunch box 1 through the film 7. Accordingly, the lunch box 1 can be filled with the inert gas, when said lunch box 1 has been sealed with the film 7, by inserting the inert gas filling needle 71 and deaerating needle 72 into the lunch box 1 through any points of said film 7.

Accordingly, even when the positioning of the filling needle 71 and the deaeration needle 72 is effected in a rough-and-ready manner in this modified embodiment in comparison with the above-mentioned fourth embodiment of the invention, the lunch box 1 can be filled with the inert gas by a very simple filling operation which can be accomplished in a short period of time (e.g. several seconds), and hence long-term preservable lunches can be mass produced.

Further, this embodiment of the invention is not limited to the details described above, and it is obvious that many modifications may be made without departing from its underlying principles and scope. For example, not only the film may be used for sealing the lunch box 1 directly as shown in FIG. 15 but also may be used for wrapping said lunch box.

As detailed hereinbefore, in the fourth embodiment of the invention, the film 7 is provided thereon with the above-mentioned self-sealing members or said film 7 is formed by using the first self-sealing layer mentioned above, the lunch box 1 can be filled with the inert gas by inserting the inert gas filling needles into the lunch box 1 through the self-sealing members or the self-sealing film without causing the leakage of gas therefrom. In the meantime, when the inert gas filling needles are withdrawn after the gas filling operation, the lunch box 1 is kept gastight without leaking the gas therefrom. In this manner, the lunch boxes can be filled with the inert gas by a very simple filling operation which can be accomplished in a short period of time (e.g. several seconds), and hence the long-term preservable lunches can be mass produced.

The fifth embodiment of the invention is illustrated below in detail.

Figure 18:
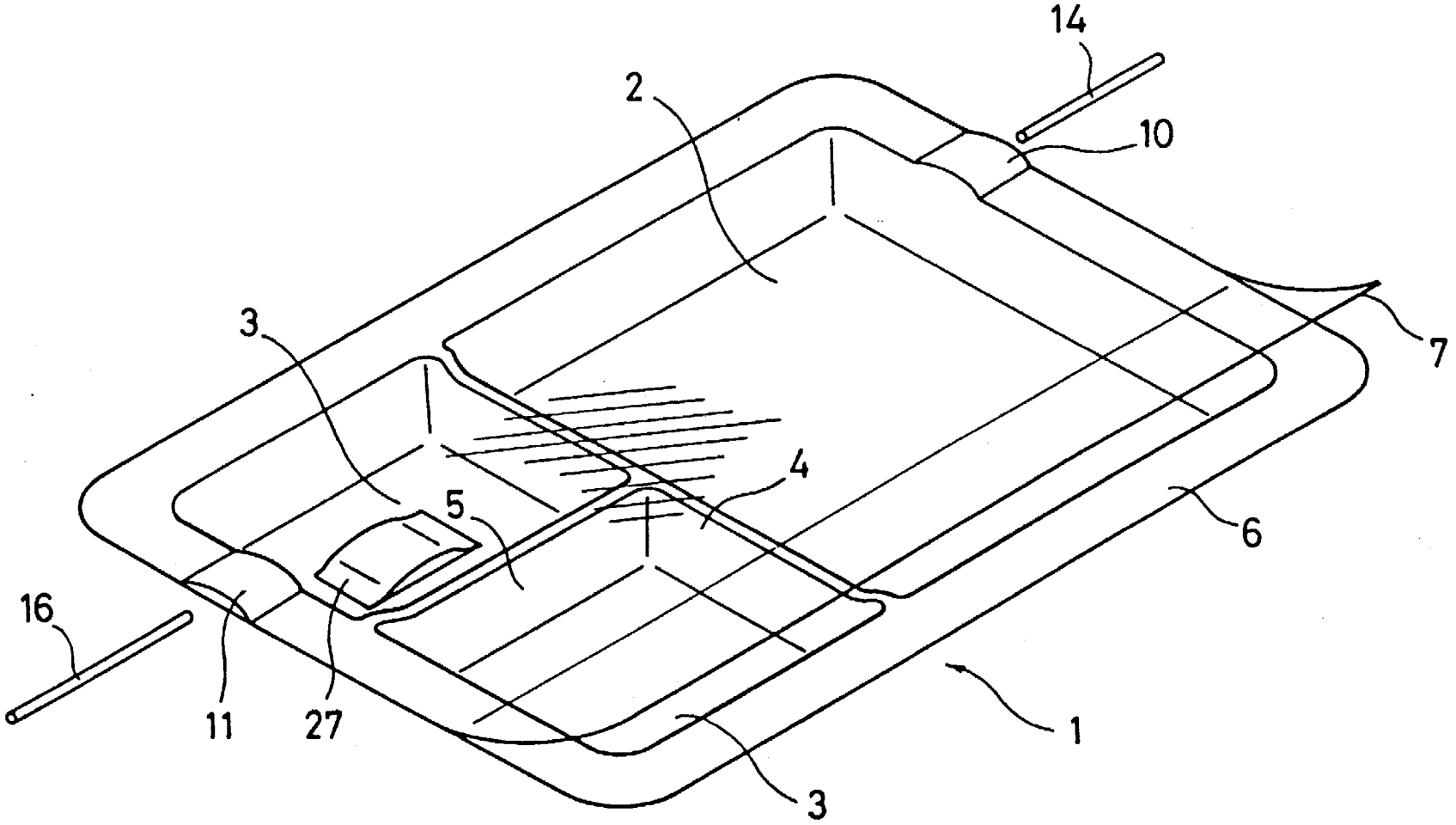
FIG. 18 is an oblique view of a lunch box according to the fifth embodiment of the invention.

FIG. 18 is an oblique view of the lunch box according to the fifth embodiment of the invention.

As shown in FIG. 18, the lunch box 1 of this embodiment of the invention comprises a section 2 for dishing up a boiled rice which is a main dish of the lunch and sections 3 for dishing up side dishes such as auxiliary articles of diet and salad. The main dish section 2 is partitioned by a wall 4 risen from the bottom wall of the lunch box 1, and similarly the side dish sections 3 are partitioned by a wall 5 risen from the bottom wall of the lunch box 1. These walls 4 and 5 are designed to be lower in height than that of the side wall of the lunch box 1.

Further, the lunch box 1 of this embodiment of the invention is provided with a flange 6 on its surrounding edge, and the flange 6 is sealed with a film 7. The film 7 may be applied to the flange 6 by any known sealing means.

In the meanwhile, the lunch box 1 of this embodiment of the invention is provided at the contacting interface between the flange 6 and film 7 with a gas filling section 10 for filling the lunch box 1 with the inert gas and a deaeration section 11 for deaerating the air present in the lunch box 1 at the time of filling said lunch box 1.

In the gas filling section 10, a sealing valve 12 is inlaid in between the flange 6 and film 7 in the same manner as shown in FIGS. 10 and 11 of the above-mentioned third embodiment of the invention. This sealing valve 12 comprises a pair of valve bodies 13*a* and 13*b* which are formed from a flexible resin. On that account, when an inert gas filling tube 14 connected to an inert gas supply source (not shown) is inserted into between the valve bodies 13*a* and 13*b*, said valve bodies 13*a* and 13*b* will deflect to such an extent that the insertion of the filling tube 14 is permitted, and this filling tube 14 is surrounded intimately by the deflected valve bodies 13*a* and 13*b*. On that account, the lunch box 1 can be filled with the inert gas through the inert gas filing tube 14 without causing leakage of the inert gas therefrom. In the meantime, when the inert gas filling tube 14 is withdrawn from the sealing valve 12, this pair of the valve bodies 13*a* and 13*b* stick together, whereby the lunch box 1 can be kept gastight.

Further, the deaeration section 11 is also provided with a sealing valve 15 having the same structure as that of the sealing valve 12 of the gas filling section 10. Accordingly, when a deaeration tube 16 is inserted into the sealing valve 15, the deaeration tube 16 is allowed to penetrate into the lunch box 1 while being surrounded intimately by the sealing valve 15, whereby the deaeration of the lunch box 1 can be effected. In the meanwhile, when said deaeration tube 16 is withdrawn from the sealing valve 15, the lunch box 1 can be kept gastight by the action of the sealing valve 15.

Accordingly, when the lunch box 1 is filled with the inert gas, the inert gas filling tube 14 and deaeration tube 16 are inserted into the sealing valves 12 and 15, respectively. The filling tube 14 and deaeration tube 16 as inserted are surrounded intimately by the sealing valves 12 and 15, respectively, and no gas and air leakage through the valves 12 and 15 will occur. Subsequently, the lunch box 1 is filled with the inert gas through the inert gas filling tube 14 and, at the same time, said lunch box 1 is deaerated by the deaeration tube 16. By virtue of this operation, after a definite period of time (several seconds), the air present in the lunch box 1 may be replaced with the inert gas. Thereafter, the filling tube 14 and the deaeration tube 16 are removed therefrom, and the lunch box 1 may be kept gastight by the action of the sealing valves 12 and 15.

In this embodiment of the invention as stated above, the lunch box 1 sealed with the film 7 can be filled with the inert gas, and the foodstuffs can be preserved within the lunch box 1 in an inert gas atmosphere. On that account, oxidation and breathing action of the foodstuffs thus preserved and also evaporation of water contained in the foodstuffs can be controlled and, as the result, the foodstuffs can be preserved in the lunch box 1 for a long period of time, wherein the foodstuffs are prevented not only from putrefaction thereof but also from deterioration of freshness, taste and fragrance thereof.

As stated above, in this embodiment of the invention, the lunch box 1 can be filled with the inert gas by a very simple filling operation which can be accomplished in a short period of time (e.g. several seconds), and accordingly the long-term preservable lunches can be mass produced.

Further, the inert gas used herein is, for example, nitrogen gas, and other gases may also be used so long as they are capable of controlling oxidation and breathing action of the foodstuffs preserved in the lunch box 1.

Furthermore, in this embodiment of the invention, the lunch box 1 is provided with an adsorption means to adsorb and fix ethylene gas generated from vegetables and fruits preserved in said lunch box 1.

This adsorption means is arranged, for example, in the side dish section 3 as shown in FIG. 18, said adsorption means being adsorbent powder 27 received in a bag. The adsorbent powder 27 includes, for example, coral powder, zeolite powder, silver-supporting zeolite powder, Ohya stone powder and acetate proof. When the silver-supporting zeolite powder is used as the adsorbent, there can also be expected bactericidal or antibacterial effect.

Because of the adsorption means as provided in the manner mentioned above, ethylene gas generated from vegetables or fruits dished up in the side dish section 3 is adsorbed by the adsorbent powder 27. On that account, ethylene generated from vegetables or fruits can be inhibited to fill up the lunch box 1, whereby the progress of aging of vegetables or fruits can be prevented to keep the vegetables or fruits in a sufficiently fresh state.

Illustrated below are modifications of the adsorption means of this embodiment of the invention.

Figure 19:
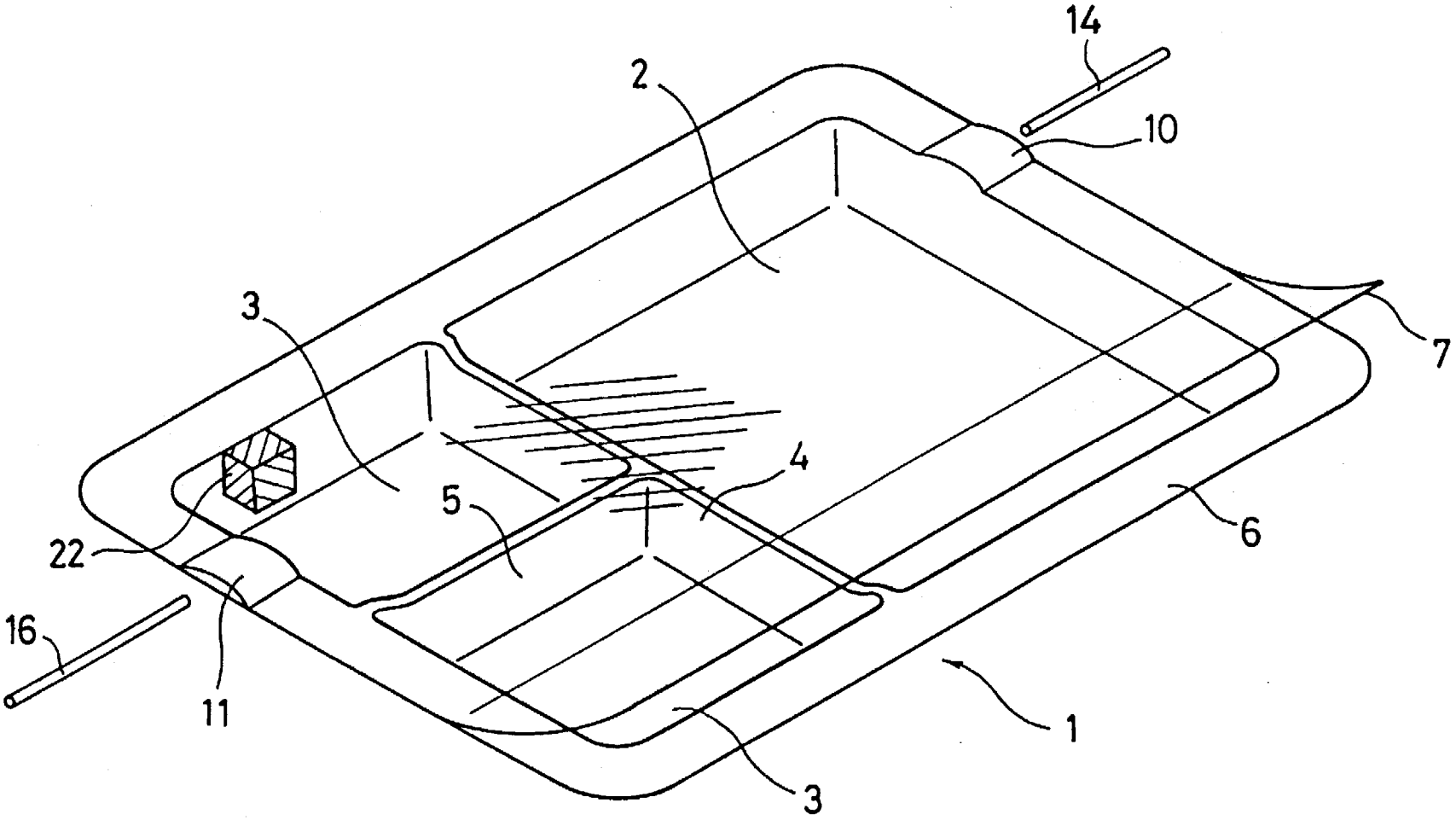
FIG. 19 is an oblique view of the lunch box showing a modification of the adsorption means shown in FIG. 18.
Figure 20:
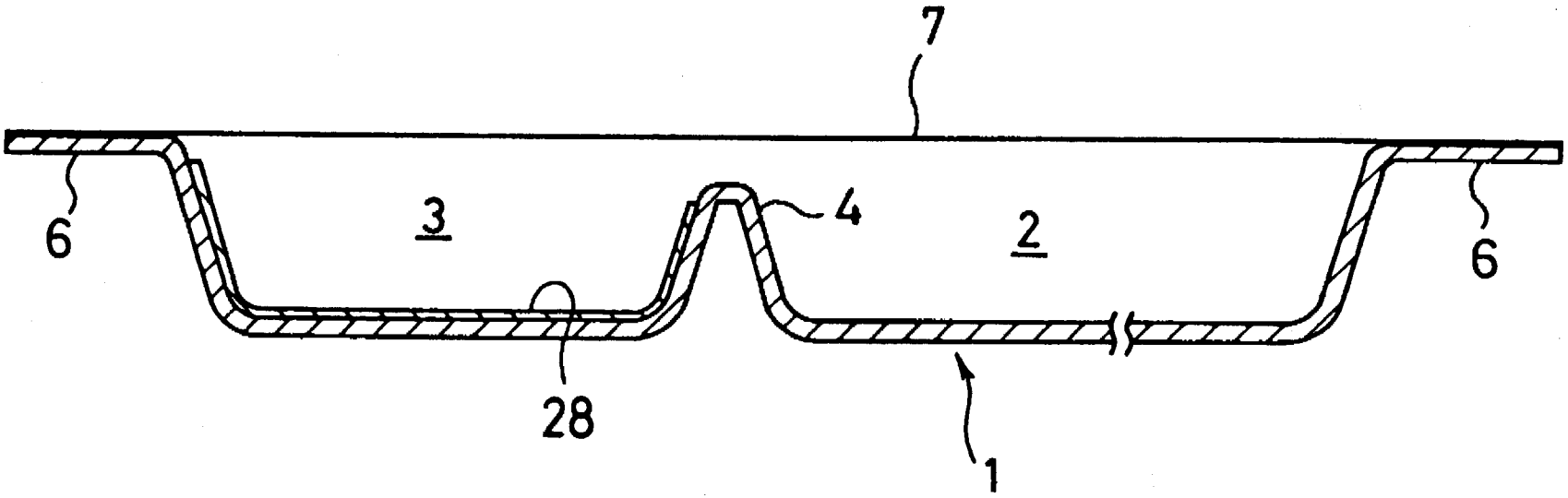
FIG. 20 is a cross section of the lunch box showing another modification of the adsorption means shown in FIG. 18.

As shown in FIG. 19, the adsorption means may be an adsorbent powder 22 formed into a cubic solid. This adsorbent powder 22 includes such adsorbent powders, for example, zeolite powder, as mentioned above.

The adsorption means may also be an adsorbent film 28 into which the adsorbent powder has been incorporated. This adsorbent film 28 is laid so as to cover the side dish sections 3, on which vegetables or fruits are dished up. The adsorbent powder incorporated into the film is the same as above, for example, zeolite powder.

The present inventor conducted a preservation test on vegetables and fruits by using this adsorption film 28. As the result, it was found that tomato was preservable for about 3 days when the adsorption film 28 was not used, but was preservable for about 6–8 days while keeping its freshness when the adsorption film 28 was used, that lettuce was preservable for about 3 days when the adsorption film was not used, but was preservable for about 10–12 days while keeping its freshness when the adsorption film 28 was used, and that apple was preservable only for 15–20 days when the adsorption film 28 was not used, but was preservable for 70–90 days while keeping its freshness when the adsorption film 28 was used.

Figure 21:
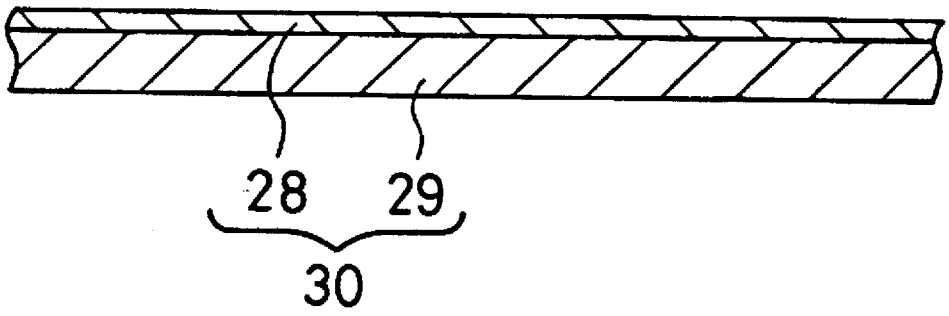
FIG. 21 is a cross section of a resin sheet forming the lunch box in which a still further modification of the adsorption means.

Further, the adsorption means may be of the following structure. That is, the adsorption film 28 is laminated on a matrix resin 29 as shown in FIG. 21 to prepare a resin sheet 30 from which the lunch box 1 is formed. In the case where the adsorption means having such a structure as mentioned above is used in the lunch box 1, the ethylene gas in the lunch box 1 can be adsorbed by the laminated sheet constituting said lunch box 1, keeping said vegetables or fruits fresh. The matrix resin 29 used herein is a thermoplastic resin film or the like.

Needless to say, the embodiment of the invention described above is given by way of illustration but not of limitation, hence various modifications may be made in the above-described details of the embodiment without departing from its underlying principles and scope. In particular, the sealing valve 12 may be those other than that shown in the accompanying drawing, and the adsorbent powder used may be those other than exemplified above.

As stated hereinbefore, according to the fifth embodiment of the invention, the lunch box sealed with the film can be filled with the inert gas, and the foodstuffs can be preserved in an inert gas atmosphere. On that account, oxidation and breathing action of the foodstuffs thus preserved and also evaporation of water contained in the foodstuffs can be controlled and, as the result, the foodstuffs can be preserved in the lunch box for a long period of time, wherein the foodstuffs are prevented not only from putrefaction thereof but also from deterioration of freshness, taste and fragrance thereof. In the fifth embodiment of the invention, moreover, because the lunch box is provided with the adsorption means to adsorb ethylene gas generated from the foodstuffs (vegetables and fruits), the ethylene gas resulting from the vegetables or fruits can be excluded by adsorption means from the lunch box, whereby the vegetables and fruits may be kept sufficiently fresh, exhibiting excellent preservability of vegetables and fruits.

The sixth embodiment of the invention is illustrated below in detail.

Figure 22:
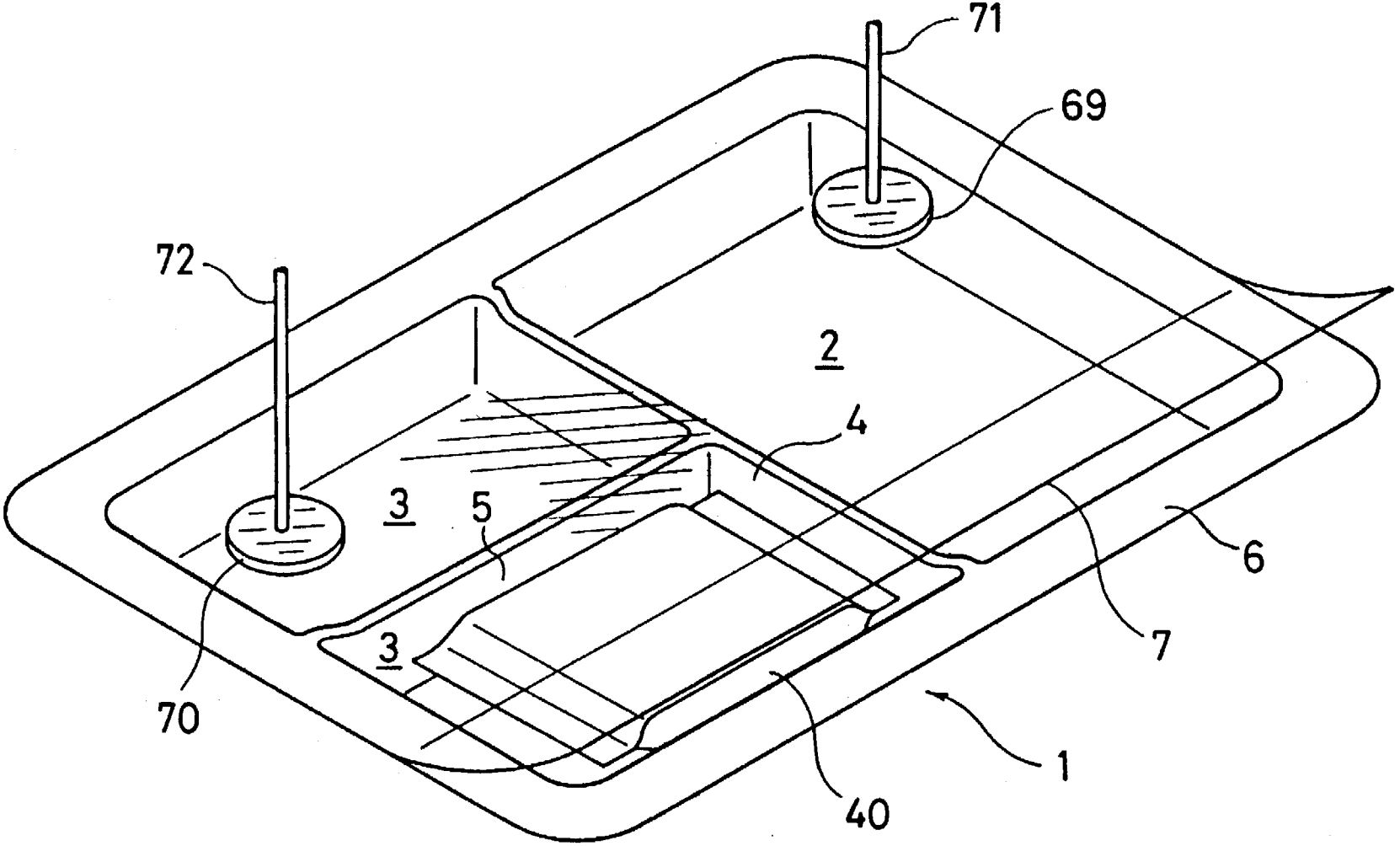
FIG. 22 is an oblique view of a lunch box according to the sixth embodiment of the invention.
Figure 23:
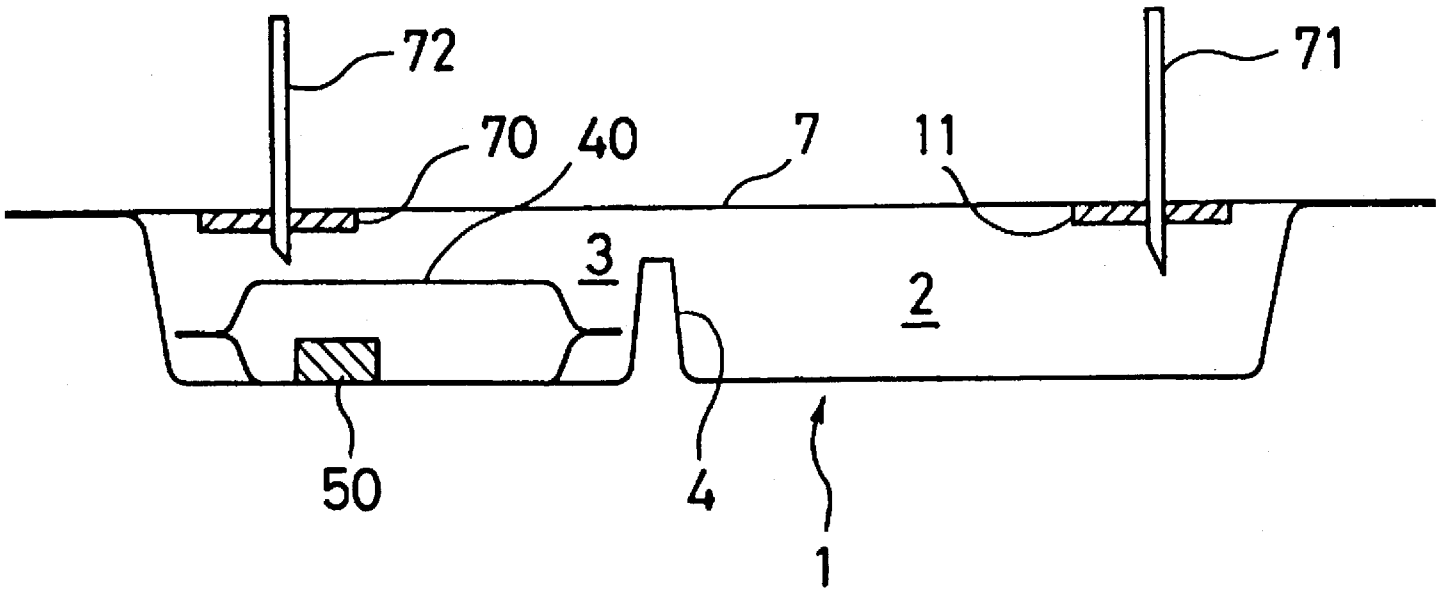
FIG. 23 is a cross section of the lunch box shown in FIG. 22.

FIG. 22 is an oblique view of the lunch box according to the sixth embodiment of the invention. FIG. 23 is a corss-sectional view of the lunch box shown in FIG. 22.

As shown in FIG. 22, the lunch box 1 according to this embodiment of the invention comprises a section 2 for dishing up a boiled rice which is a main dish of the lunch and sections 3 for fishing up side dishes such as auxiliary articles of diet and salad. The main dish section 2 is partitioned by a wall 4 risen from the bottom wall of the lunch box 1, and similarly the side dish sections 3 are partitioned by a wall 5 risen from the bottom wall of the lunch box 1. These walls 4 and 5 are designed to be lower in height than that of the side wall of the lunch box 1.

Further, the lunch box 1 of this embodiment of the invention is provided with a flange 6 on its surrounding edge, and this flange 6 is sealed with a film 7 which will cover the upper side of the lunch box 1. The sealing means employed herein may be any of those hitherto known.

The film 7 is provided on its surface with self-sealing members 69 and 70. The self-sealing member 69, when an inert gas filling needle 71 is inserted into the lunch box 1 through said self-sealing member 69, will keep said lunch box 1 airtight, and will make it possible to fill said lunch box 1 with the inert gas through said inert gas filling needle 71. In the meantime, when the inert gas filling needle 71 is withdrawn therefrom, said lunch box 1 may be kept airtight. This self-sealing member 69 is formed from a material low in hardness and having stickiness, and when the safety of food is taken into account, such material includes photosensitive materials, silicone rubber and silicone gel. The self-sealing member 70 is formed also from the same materials as used in the self-sealing member 69.

Accordingly, when the lunch box 1 is filled with the inert gas, the inert gas filling needle 71 and deaeration needle 72 are inserted into the lunch box 1 through the self-sealing members 69 and 70, respectively. Because the filling needle 71 and the deaeration needle 72 are surrounded intimately by the self-sealing members 69 and 70, respectively, the gas and air will not leak through the self-sealing member 69 and 70. subsequently, the filling of the lunch box 1 with the inert gas through the inert gas filling needle 71 is initiated and, at the same time, the air in the lunch box 1 is discharged therefrom through the deaeration needle 72. By virtue of this operation, after the lapse of a definite time (several seconds), the air in the lunch box 1 is replaced with the inert gas. Thereafter, the filling needle 71 and deaeration needle 72 are removed therefrom, the lunch box 1 is kept airtight by the action of the self-sealing members 69 and 70. In this manner, the lunch box 1 can be filled with the inert gas by a very simple filling operation which is accomplished in a short period of time (e.g. several seconds), and accordingly there can be mass produced long-term preservable lunches.

The inert gas used herein is, for example, nitrogen gas, and of course other inert gases are usable so long as they can control oxidation and breathing action of the foodstuffs.

In this embodiment of the invention, there is arranged in the side dish section 3 of the lunch box 1 a bag 40 for receiving therein fruits or vegetables for which freshness is particularly required.

This receiving bag 40 is formed preferably from a film small in oxygen-permeability and excellent in safety, for example, polyethylene film, polypropylene film, polyester film or Pluran film. Of these films, most preferred is Pluran film composed of a water-soluble and viscous polysaccharide forming no gel and having such characteristics that said film is edible and small in oxygen permeability. Further, this Pluran film has such an advantage that when the lunch is rewarmed by heating, the trouble required for removing said film can be saved.

In this embodiment of the invention, the receiving bag 40 is provided with an adsorption means for adsorbing ethylene gas generated from the fruits or vegetables in said receiving bag 40.

This adsorption means is, for example, an adsorbent powder 50 formed into a cubic solid. This adsorbent powder 50 includes, for example, coral powder, zeolite powder, silver-supporting zeolite powder, Ohya stone powder and acetate proof. When the adsorbent powder 50 used is a silver-surrounding zeolite powder, there can be expected antibacterial and bactericidal effects.

In this manner, because the adsorbent powder 50 to adsorb the ethylene gas generated from fruits or vegetables is arranged in the receiving bag 40, the ethylene gas can be removed therefrom, whereby the fruits or vegetables can be kept fresh sufficiently. Moreover, the ethylene gas generated from the fruits or vegetables can be removed by receiving then in the receiving bag 40 as soon as they come to hand of producers, and thereafter said receiving bag 40 is arranged in the lunch box 1. Accordingly, the breathing action of the fruits or vegetables for which freshness thereof particularly required can be controlled at the point when they come to hand of the producers, and the fruits or vegetables dished up in the lunch box 1 can be preserved for a long period of time while preventing effectively change of quality, putrefaction or deterioration thereof.

The adsorption means employed in this embodiment of the invention is further illustrated below with reference to modifications thereof.

Though not shown, the modified adsorption means may be prepared by storing a bag with the adsorbent powder, as it is, and arranging said bag in the above-mentioned receiving bag 40. In this case, there can be exhibited the same function and effect as mentioned above.

A further modification of the adsorption means of this embodiment of the invention is an adsorption film prepared by incorporating the adsorbent powder into a film, from which the above-mentioned receiving bag 40 may be formed.

The present inventor conducted a preservation test on salad using this adsorption film. As the result, it was found that tomato was preservable only for about 3 days when no adsorption film was used, but was preservable for about 6–8 days while keeping its freshness when the adsorption film was used, and that lettuce was preservable only for about 3 days when no adsorption film was used, but was preservable for about 10–12 days while keeping its freshness when the adsorption film was used. It was further found that apple was preservable only for about 15–20 days when no adsorption film was used, but was preservable for about 70–90 days while keeping its freshness when the adsorption film was used.

Another modification of the adsorption means of this embodiment of the invention may be formed in the following manner. That is, as shown in FIG. 21 of the above-mentioned fifth embodiment of the invention, the resin sheet 30 is prepared by laminating the above-mentioned adsorption film 28 having been incorporated with the adsorbent powder with the matrix resin 29, and the above-mentioned receiving bag 40 is formed from said resin sheet 30. In this case, the ethylene gas generated from the fruits or vegetables preserved in the receiving bag 40 can be adsorbed thereby, while keeping said fruits or vegetables fresh. The matrix resin 29 used in preparing the resin sheet 30 is a thermoplastic film or the like.

Needless to say, this embodiment of the invention is not limited to the above-mentioned details, and various modifications thereof can be made. For example, the material used for making the receiving bag 40 is not limited to such films as exemplified in this embodiment of the invention, but may be other films so long as they are useful for the purpose intended.

As stated hereinbefore, according to the sixth embodiment of the invention, because the lunch box 1 is provided with the adsorption means to adsorb the ethylene gas generated from the fruits and vegetables, the ethylene gas can be adsorbed by the adsorbent of the adsorption means in the receiving bag 40 storing said fruits or vegetables, thereby keeping the fruits or vegetables fresh sufficiently. Moreover, the ethylene gas generated from the fruits or vegetables can be removed by receiving them in the receiving bag as soon as they come to hand of producers, and thereafter said receiving bag is arranged in the lunch box. Accordingly, the breathing action of the fruits or vegetables for which freshness thereof is particularly required can be controlled at the point when they come to hand of the producers, and the fruits or vegetables dished up in the lunch box can be preserved for a long period of time while preventing effectively change of quality, putrefaction or deterioration thereof. Needless to say, because the lunch box is filled with the inert gas, foodstuffs other than the fruits or vegetables can be preserved in the lunch box while preventing them not only from putrefaction thereof but also from deterioration of freshness, taste and fragrance thereof.

The present invention has been illustrated on the basis of the above-mentioned embodiments thereof with reference to the accompanying drawings, the invention may also be carried out in the following manner.

For example, the protuberant boiled rice or the like dished up in the lunch box is raked off while conveying said lunch box by a conveyor, said lunch box is allowed to pass through a preparatory chamber deaerated and filled with an inert gas, and said lunch box is sealed with a film in a sealing chamber filled with the inert gas and, at the same time, the inert gas is blown into unfilled spaces of said lunch box.

Further, the protuberant boiled rice or the like dished up in the lunch box is raked off while conveying said lunch box by a conveyor, said lunch box is allowed to pass through a preparatory chamber deaerated and filled with an inert gas, said lunch box is sealed with a film in a seal cooling chamber filled with the inert gas while cooling said lunch box to a temperature of up to −1° C. and, at the same time, the inert gas is blown into unfilled spaces of said lunch box.

Furthermore, after passing the lunch box, from which the protuberant portions of the dish have been raked off, through a preparatory chamber deaerated and filled with the inert gas, said lunch box is sealed with a film in a seal cooling chamber filled with the inert gas while cooling said lunch box to a temperature below −8° C. and, at the same time, the nitrogen gas obtained by vaporization of liquid nitrogen is blown into unfilled spaces of said lunch box.

Still further, from the lunch box in which boiled rice and the like have been dished up, the protuberant portion of said boiled rice is raked off while conveying said lunch box. The lunch box is then allowed to pass by means of a conveyor through a preparatory chamber into which nitrogen gas is introduced. Subsequently, nitrogen gas is blown into the lunch box while cooling rapidly said lunch box in a seal cooling chamber, and said lunch box is sealed with a film.

Even when the present invention is carried out by the methods just mentioned above, the long-term preservable lunches can be mass produced in the same way as in the aforementioned embodiments of the invention.

What is claimed is:

1. A production unit for preparing long-term preservable lunches, said production unit comprising:

conveying means for conveying lunch boxes in which foodstuffs are dished up;

a plurality of gas chambers through which said conveying means extends wherein each of said plurality of gas chambers is filled with an inert gas, wherein adjacent gas chambers are separated by a curtain of inert gas and wherein said gas chambers are disposed successively in a conveying direction of said conveying means;

filling means for filling a series of said gas chambers with an inert gas so that an inert gas concentration in said gas chambers of the series increases in the conveying direction of the conveying means; and sealing means for gas tightly sealing an upper surface of each lunch box with a film, wherein said sealing means is located in a gas chamber having the highest inert gas concentration.

2. The production unit of long-term preservable lunches as claimed in claim 1, including at least one other gas chamber through which the sealed lunch boxes are conveyed, wherein said at least one other gas chamber is located adjacent a downstream side of said gas chamber having the highest inert gas concentration and wherein the inert gas concentration of said at least one other gas chamber is maintained by said filling means at a level lower than the inert gas concentration of said gas chamber having the highest inert gas concentration.

3. The production unit of long-term preservable lunches as claimed in claim 1, wherein each curtain of inert gas is formed between a first gas ventilation hole arranged above the conveying means and second gas ventilation holes arranged at each side of the conveying means, said second gas ventilation holes located at a position lower than the conveying means.

4. The production unit of long-term preservable lunches as claimed in claim 1, wherein each air curtain is formed between a first gas ventilation hole located adjacent one side of said conveying means and a second gas ventilation hole located adjacent the other side of the conveying means, said first and second ventilation holes being arranged at a position above said conveying means.

5. The production unit of long-term preservable lunches as claimed in claim 1, wherein a most upstream gas chamber is separated from ambient air by an air curtain.

6. The production unit of long-term preservable lunches as claimed in claim 1, wherein a most downstream gas chamber is separated from ambient air by an air curtain.

7. The production unit of long-term preservable lunches as claimed in claim 2, wherein each curtain of inert gas is formed between a first gas ventilation hole arranged above the conveying means and second gas ventilation holes arranged at each side of the conveying means, said second gas ventilation holes located at a position lower than the conveying means.

8. The production unit of long-term preservable lunches as claimed in claim 2, wherein each air curtain is formed between a first gas ventilation hole located adjacent one side of said conveying means and a second gas ventilation hole located adjacent the other side of the conveying means, said first and second ventilation holes being arranged at a position above said conveying means.

9. The production unit of long-term preservable lunches as claimed in claim 2, wherein a most upstream gas chamber is separated from ambient air by an air curtain.

10. The production unit of long-term preservable lunches as claimed in claim 2, wherein a most downstream gas chamber is separated from ambient air by an air curtain.

* * * * *